US010548785B2

(12) United States Patent
Vermij et al.

(10) Patent No.: US 10,548,785 B2
(45) Date of Patent: Feb. 4, 2020

(54) HAND PROPELLED WHEELED VEHICLE

(71) Applicant: Vermij Works Inc., Ottawa (CA)

(72) Inventors: Hans Vermij, Bedford, TX (US); Maximiliaan Vermij, Ottawa (CA); Mitchel James MacLatchie, Ottawa (CA)

( * ) Notice: Subject to any disclaimer, the term of this patent is extended or adjusted under 35 U.S.C. 154(b) by 33 days.

(21) Appl. No.: 15/631,452

(22) Filed: Jun. 23, 2017

(65) Prior Publication Data

US 2017/0367911 A1 Dec. 28, 2017

Related U.S. Application Data

(60) Provisional application No. 62/353,869, filed on Jun. 23, 2016.

(51) Int. Cl.
*A61G 5/02* (2006.01)
*A61G 5/10* (2006.01)

(52) U.S. Cl.
CPC ..... *A61G 5/025* (2013.01); *A61G 5/021* (2013.01); *A61G 5/1051* (2016.11)

(58) Field of Classification Search
CPC ..... A61G 5/025; A61G 5/021; A61G 5/022; A61G 5/023
See application file for complete search history.

(56) References Cited

U.S. PATENT DOCUMENTS 4,282,442 A 8/1981 Massinger
4,560,181 A * 12/1985 Herron ..... A61G 5/023 280/244
5,007,655 A * 4/1991 Hanna ..... A61G 5/023 280/245
5,383,675 A * 1/1995 Liebert ..... B62K 21/00 114/144 R
6,158,757 A 12/2000 Tidcomb
6,916,032 B2 * 7/2005 Wong ..... A61G 5/023 280/242.1
7,341,267 B2 * 3/2008 Vroom ..... A61G 5/023 280/250
8,186,699 B2 5/2012 Green
9,486,372 B2 * 11/2016 Robins ..... A61G 5/125
2009/0283982 A1 * 11/2009 Thomas ..... A61G 5/023 280/234
2011/0215547 A1 * 9/2011 Davenport ..... A61G 5/023 280/250.1

(Continued)

*Primary Examiner* — Joseph M Rocca
*Assistant Examiner* — Michael R Stabley
(74) *Attorney, Agent, or Firm* — The Roy Gross Law Firm, LLC; Roy Gross

(57) ABSTRACT

A hand propelled wheeled vehicle, specifically a wheelchair, containing a pair of hand actuated, lever driven mechanisms to rotate the main wheels. The levers pivot around attachment points on the left and right sides of the vehicle chassis. The left lever actuates a frame responsible for contra-rotating two integral one-way clutches arranged on a drive shaft coupled to the left main wheel, with the right lever operating the right side mechanism in an identical fashion. The arrangements of the clutches utilize both the forward (pushing) and backward (pulling) stroke of the lever to rotate the main wheels forward. Steering and braking control is afforded through attachments integral to the hand grips of the right and left hand levers, respectively.

12 Claims, 21 Drawing Sheets

(56) References Cited

U.S. PATENT DOCUMENTS

| | | | | |
|---|---|---|---|---|
| 2013/0015632 | A1 | 1/2013 | Winter, V et al. | |
| 2015/0190292 | A1* | 7/2015 | Robins | A61G 5/125 180/366 |

* cited by examiner

35

35

235

HAND PROPELLED WHEELED VEHICLE

FIELD OF THE INVENTION

The present invention relates generally to a wheeled device and more specifically to a hand propelled device for wheeled vehicles.

BACKGROUND

Hand propelled devices provide not only a means of mobility and independence for people who have difficulty walking, but can also provide a means of efficient travel and a form of exercise for able bodied people. In addition, Hand propelled devices can provide an alternative means for children to commute short distances and to play with their peers. The main drawback to hand/arm propelled devices in the industry is that hand propelled devices are inefficient and require substantial hand and arm strength and stamina to operate for long durations. As such, the majority of exercise devices and children's toys operate through foot and leg propulsion.

In situations where individuals have difficulty walking, hand/arm propelled devices, such as wheelchairs, are a practical method of human powered travel. The usual means of propelling wheelchairs is through the use of annular hand rails attached to the two main driving wheels. This method is not efficient and contorts the rider's body in a potentially unhealthy manner. The continual unidirectional movement and hunched over riding position may be unhealthy as it tends to constrict the chest and arms. Additionally, the use of annular hand rails to propel the wheels is an inefficient use of energy, and can be exhausting to use over longer distances and on rough terrain. Other attempts at designing alternative mechanisms for wheelchair propulsion suffer similar problems, as they feature a power stroke in one direction only, which is strenuous on the upper body.

Additionally, most hand propelled devices, such as wheelchairs, are difficult to steer. The mechanism of steering generally involves altering the speed of one wheel independent of the other wheel. Other mechanisms involve the use of a steering mechanism that alters the direction of the front wheel(s) of the propelled device, but requires removal of at least one hand from the drive wheel.

Inventions such as U.S. Pat. No. 8,186,699 (Green), U.S. Pat. No. 5,007,655 (Hanna), US Patent Publication US2013/0015632 (Winter), and U.S. Pat. No. 6,158,757A (Tidcomb) have been devised in order to provide hand propelled wheeled vehicles.

Green discloses a manual propulsion mechanism for wheelchairs. The mechanism utilizes a lever pivotally mounted to the hub of each drive wheel such that the wheelchair operator can propel the chair with push/pull movements of the lever. Forward and reverse propulsion is accomplished by a system of two one-way, opposing clutches contained within wheel hubs that are controlled by shifting of the lever handgrips. Only one of the strokes of the lever is converted into rotary motion of the wheel at any given time. The return stroke is only engaged when the reverse direction is selected by the operator through movement of the hand grip, which as a result propels the wheelchair backwards. Green is an inefficient use of the lever system as it uses only one of the stroke directions to propel the wheelchair forward, and can only feasibly rotate the wheel less than one quarter of a full rotation (360°) for one stroke.

Hanna discloses a lever propelled wheelchair wherein only the forward stroke propels the wheels as the return stroke does not affect the rotation of the wheel as the clutch disconnects the lever from the wheel drivetrain. Hanna employs a rack that connects the lever to the wheel drivetrain. The rack converts the linear motion of the lever into rotational force of the drivetrain by linearly running over the drivetrain gear, causing the gear and the wheel, to rotate. Hanna, like Green is a less efficient system, as only one of the two strokes is employed to propel the wheelchair forward. Additionally, the unidirectional effort can cause physiological strain.

Winter discloses a manually powered wheelchair propelled through the use of a left and right lever. The drivetrain is comprised of driven and driving sprockets which convert the linear motion to rotational motion. The diametric ratio between the driven and driving sprocket is either 4:1 or 3:1 and gives mechanical advantage. Hand position along the tall levers can be modified to change the amount of torque applied. As with Green and Hanna, Winter only uses the forward stroke to propel the wheels, the return stroke ratchets and resets the gear train for the next power stroke. This style of ratcheting lever only allows a fraction of a full rotation (360°).

Tidcomb discloses an operator-propelled vehicle driven by a hand lever system, where a flexible cable member is connected to the drive lever, and wrapped around a wheel drum. The state of tension on the wrapped cable is selected by the operator by closing a grip lever to assume a tensioned state driving the chair, or releasing the grip lever assuming a slackened state allowing for freewheeling. As such, when the lever is moved through a push or pull stroke, and depending on the grip lever position, the wheel will rotate with the movement of the lever under a tensioned cable, and the wheel will not be acted on by a slackened cable. The operator can only use one stroke direction to propel the wheel forward, and the mechanism necessitates learning a coordinated technique to tension and slacken the cables at the appropriate times during power and return strokes to effectively use the vehicle at speed.

Other inventions have attempted to harness forward and backward linear strokes to provide rotary motion. U.S. Pat. No. 4,282,442 (Massinger) discloses a device for converting linear reciprocal motion to continuous rotary motion whereby both forward and backward strokes of the reciprocal motion contribute to the power output of the device. Massinger employs two one-way clutches, wherein during the forward stroke, the first clutch engages and the second clutch slips, while during the backward stroke, the first clutch slips and the second clutch engages. Massinger discloses a complicated system with numerous gears and a large number of moving parts, intended for use in industries such as power generation and heavy machinery. The design is not specifically tailored to vehicle locomotion.

As such, there is a need in the industry for a hand propelled wheeled device that is efficient at converting the linear force applied by the operator into rotational force at the main wheels. The efficiency stems from converting both the forward and return strokes to forward rotation of the wheels, thus propelling the wheeled device forward. In addition, a single stroke of the lever should equate to a full rotation of the mechanism, thus, the operator is not expending energy with multiple strokes for just one wheel rotation. None of the prior art provides for a full wheel rotation with just one power stroke. Furthermore, the steering mechanism of the prior art is inefficient, if present at all. With traditional wheelchair steering mechanisms, the operator steers by manipulating the speed of the main wheels and not through a dedicated steering mechanism, as the operator's hands are occupied with propulsion of the chair. This is an inefficient method of steering, as the operator uses friction to slow down one wheel in order to turn in one direction.

None of the prior art provides for a mechanism of steering the wheeled vehicle outside varying the speed of the rear wheels, except Tidcomb. Although a steering mechanism is present in Tidcomb's design, the steering wheels are not controlled to follow the proper arc for a given turning radius. The steering wheels are fixed to both rotate at the same angle relative to a straight forward path leading to frictional losses and wheel slippage, which could negatively impact running speed turning performance.

Further, the propulsion mechanism disclosed herein can be adapted to perform tasks other than that of propelling the hand powered wheeled vehicle. It can be used in any case where the need arises for a mechanism requiring reciprocal, linear input to be converted into unidirectional rotational output, such as pumps, electricity generators, or any other applicable industrial scenario.

SUMMARY

The Hand Propelled Wheeled Vehicle is primarily comprised of a frame that accommodates the rider and at least one drive wheel that is connected to a propulsion mechanism. To propel the Hand Propelled Wheeled Vehicle, the rider applies linear force to the propulsion mechanism which converts forward and backward linear force into forward rotational force that subsequently rotates the at least one drive wheel mounted to the frame and propels the Hand Propelled Wheeled Vehicle forward. A single stroke through the functional range of the propulsion mechanism, either forward or backwards, is converted into forward rotational force that provides one full rotation of the at least one drive wheel. In addition, the Hand Propelled Wheeled Vehicle contains an efficient means of providing directional control and braking.

| Table of Described Drive Mechanisms | |
|---|---|
| Fixed Cable/Pulley Harp Mechanism | A |
| Wraparound Tensioned Cable/Pulley Harp Mechanism | B |
| Rack and Pinion Gear Harp Mechanism | C |
| Sprocket and Pin Rack Harp Mechanism | D |
| Floating Sprocket and Chain Mechanism | E |
| Fixed Sprocket and Chain Mechanism | F |
| Ballscrew/Differential Gear Mechanism | G |

| Parts Labelled in the Drawings | |
|---|---|
| 10 | Hand Propelled Wheeled Vehicle |
| 12 | Chassis |
| 15 | Frame |
| 20 | Seat |
| 22 | Backrest |
| 24 | Right Steering Wheel |
| 25 | Left Steering Wheel |
| 30 | Left/Right Drive Wheel |
| 31 | Wheel Hub |
| 32 | Drive Shaft |
| 33 | Axle Mounting Adaptor |
| 34 | Fixed Axle |
| 35 | Harp Drive Mechanism |
| 40 | Left Drive Lever Assembly |
| 41 | Right Drive Lever Assembly |
| 45 | Axle Tube |

-continued

| Parts Labelled in the Drawings | |
|---|---|
| 50 | Steering Wheel Mount |
| 55 | Foot Rest |
| 60 | Propulsion Mechanism |
| 64 | Inner Clutch Driver |
| 65 | Outer Clutch Driver |
| 70 | Harp Attachment Knuckle |
| 71 | Lever Shaft |
| 72 | Lever Pivot Block |
| 75 | Drive Ratio Handle |
| 80 | Harp Frame |
| 81 | Upper Harp Beam |
| 82 | Lower Harp Beam |
| 83 | Front Harp Pillar |
| 84 | Rear Harp Pillar |
| 86 | Inner Idling Cable |
| 87 | Inner Driving Cable |
| 88 | Outer Driving Cable |
| 89 | Outer Idling Cable |
| 90 | Drive Shaft Assembly |
| 91 | Brake Disc |
| 95 | Inner One-Way Clutch |
| 100 | Outer One-Way Clutch |
| 105 | Coupling Lever Assembly |
| 110 | Drive Shaft Bearings |
| 115 | Upper Linear Gear Rack |
| 116 | Lower Linear Gear Rack |
| 120 | Locking/Unlocking Lever |
| 125 | Driving Hirth Coupling Member |
| 127 | Drive Transfer Pins |
| 130 | Belleville Spring Stack |
| 135 | Hirth Coupling Assembly |
| 140 | Pin Rack |
| 141 | Harp Pin |
| 145 | Driven Hirth Coupling Member |
| 150 | Drive Block |
| 154 | Inner Idler Sprocket |
| 155 | Outer Idler Sprocket |
| 165 | Inner Drive Chain |
| 170 | Outer Drive Chain |
| 175 | Floating Support Rail |
| 181 | Chain Drive Handle |
| 185 | Fixed Support Rail |
| 195 | Ball Nut Drive Sleeve |
| 210 | Ball Nut |
| 211 | Ball Bearings |
| 215 | Ballscrew |
| 220 | Ballscrew Bearing |
| 225 | Driving Bevel Gear |
| 230 | Mechanism Housing |
| 235 | Steering System |
| 240 | Steering Controller |
| 245 | Right Steering Cable |
| 250 | Left Steering Cable |
| 255 | Right Steering Assembly |
| 256 | Left Steering Assembly |
| 260 | Right Steering Column |
| 261 | Right Suspension Fork |
| 265 | Steering Tie Rod |
| 270 | Left Steering Column |
| 271 | Left Suspension Fork |
| 285 | Steering Drive Disc |
| 290 | Braking Mechanism |
| 295 | Brake Lever |
| 300 | Brake Caliper |
| 310 | Brake Line |
| 315 | Brake Caliper Mount |

BRIEF DESCRIPTION OF THE DRAWINGS

It will now be convenient to describe the invention with particular reference to one embodiment of the present invention. It will be appreciated that the drawings relate to one embodiment of the present invention only and are not to be taken as limiting the invention.

DETAILED DESCRIPTION

The present invention will now be described more fully hereinafter with reference to the accompanying drawings, in which preferred and other embodiments of the invention are shown. This application refers to seven possible embodiments of the invention, having the designations A through G as per the table of contents. No embodiment described below limits any claimed invention, and any claimed invention may cover processes or apparatuses that are not described below. The claimed inventions are not limited to apparatuses or processes having all the features of any one apparatus or process described below or to features common to multiple or all of the apparatuses described below. It is possible that an apparatus or process described below is not an embodiment of any claimed invention. The applicants, inventors or owners reserve all rights that they may have in any invention claimed in this document, for example the right to claim such an invention in a continuing application and do not intend to abandon, disclaim or dedicate to the public any such invention by its disclosure in this document.

Figure 1:
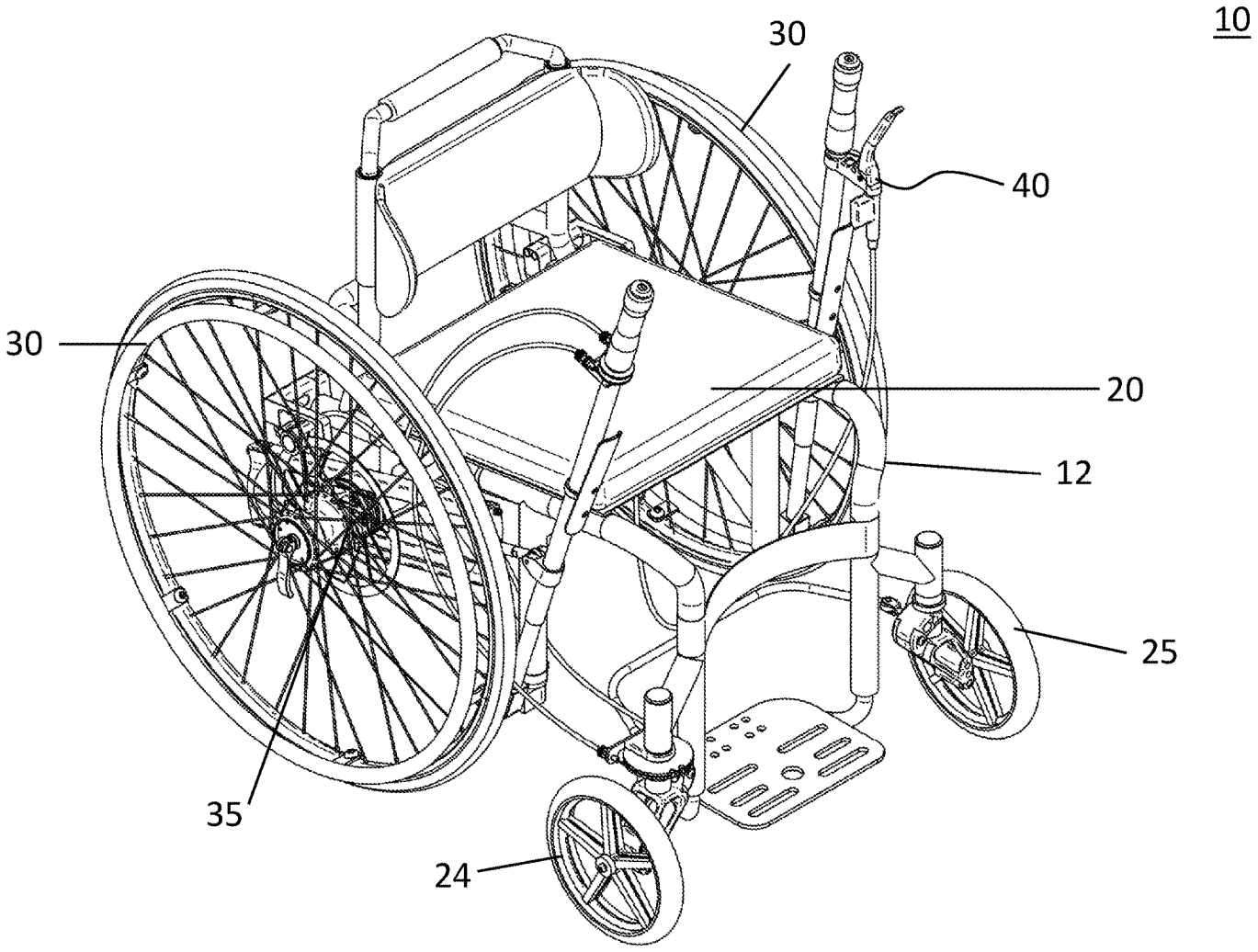
FIGS. 1 and 2 are perspective views of a complete hand propelled wheelchair according to one embodiment of the present invention.
Figure 2:
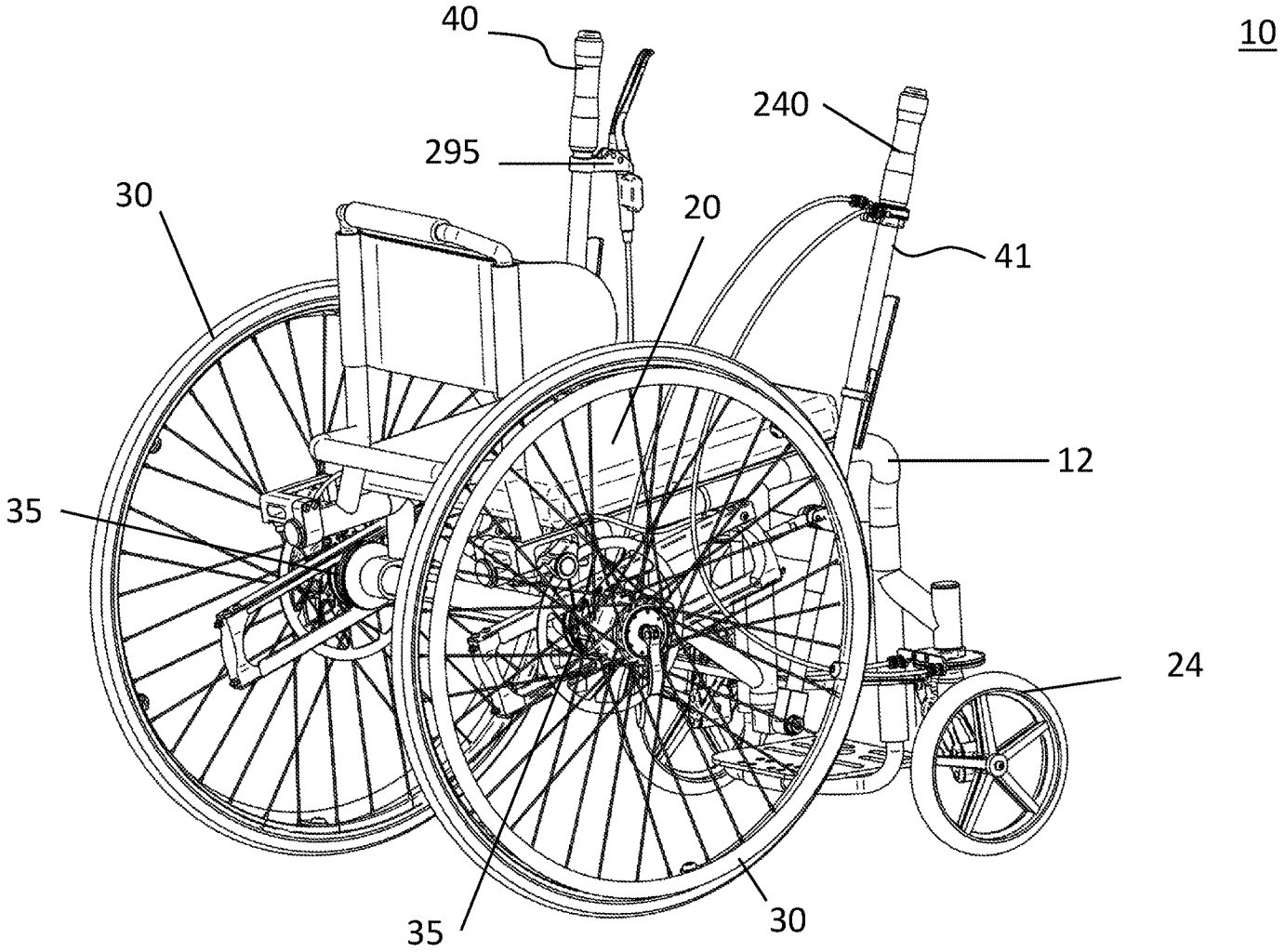

With reference to FIGS. 1 and 2, and according to one embodiment of the present invention, a hand propelled wheeled vehicle is described in greater detail. The hand propelled wheeled vehicle 10 is primarily comprised of: a chair frame 15; seat 20; right and left steering wheels, 24 and 25, respectively; drive wheels 30; harp drive mechanism 35; left drive lever assembly 40; and right drive lever assembly 41. The hand propelled wheeled vehicle converts the operator's linear arm force to rotation that acts on the drive wheels 30 to propel the hand propelled wheeled vehicle. For clarity, the left drive lever 40 will be referred to for the purposes of outlining the drive mechanism function, as the right drive lever assembly 41 produces the identical motion on the opposite side of the vehicle. A single stroke through the functional range of the drive lever assembly 40, either forward or backwards, is converted into forward rotational force that provides one full rotation of the drive wheel 30. The operator exerts forward and backward linear motion on the drive lever assembly 40 to produce a stroke, which pushes or pulls the harp drive mechanism 35. The linear movement of the harp drive mechanism 35 frame rotates clutch drivers (not shown), which in turn rotate the drive wheels 30. The embodiment of the hand propelled wheeled vehicle described within the patent application relates to a wheelchair. A worker skilled in the relevant art would appreciate that a hand propelled wheeled vehicle can be embodied as a number of different vehicles, such as, but not limited to: a bicycle; tricycle; go cart; rower; and any other wheeled land vehicle that requires the operators force to propel the vehicle. In addition, and in another embodiment of the present invention, the hand propelled wheeled vehicle can be a hand propelled water device such as, but not limited to: a boat, canoe, wheeled rower, or any other human powered watercraft; and can be used in any small boat as the means of propulsion. The water craft application would require peripheral design modifications to the drive output, such as the addition of fins or propellers, to adapt the vehicle to water. A worker skilled in the relevant art would appreciate the various ways that the propulsion mechanism described herein can be modified to propel the craft through water.

Figure 3:
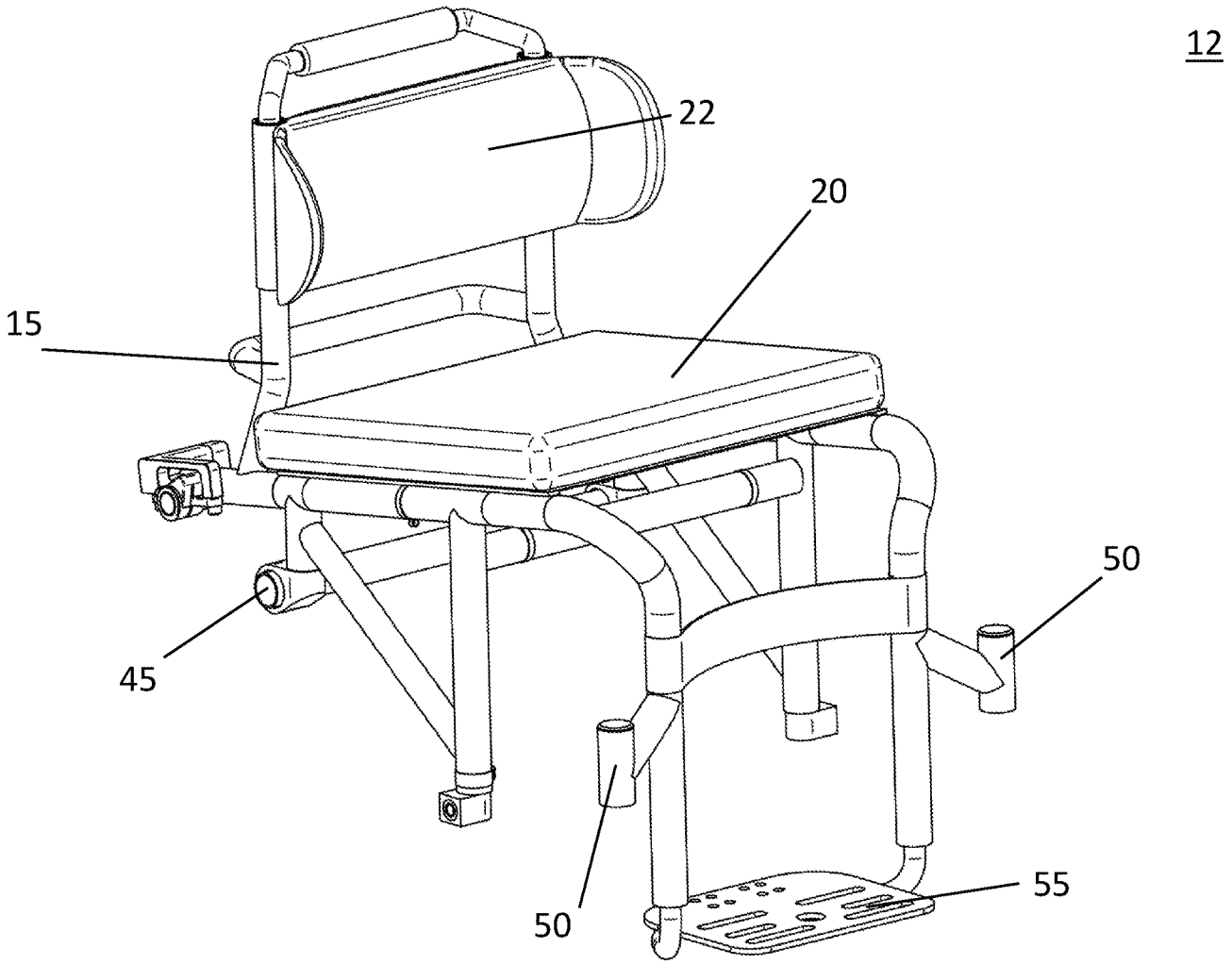
FIG. 3 is a perspective view of a hand propelled wheelchair chassis according to one embodiment of the present invention.

With reference to FIG. 3 and according to one embodiment of the present invention, the chair chassis 12, comprised of: the frame 15 and the seat 20, is described in more detail. The chair frame 15 is comprised of a tubular structure formed to accommodate the operator in a sitting position. The material used for the tubular structure can be comprised of a number of different metals or composites that are light weight and have sufficient rigidity. A worker skilled in the relevant art would appreciate the various structures that can maximize rigidity and form the shape of the chair frame 15. The chair frame 15 contains an axle tube 45 and steering wheel mounts 50. The axle tube 45 connects the drive wheel (not shown) to the chair frame 15. A drive wheel assembly (not shown) is set within the axle tube 45 which connects the drive wheel (not shown) to the chair frame 15. In a similar manner, the steering wheel mount 50 connects the chair frame 15 to the steering wheels (not shown). The location for the steering wheel mount 50 allows for the connection of the steering system. The seat 20 is set on top of the chair frame 15 at the location where the operator would sit. The seat 20 provides support and comfort to the operator while seated in the hand propelled wheeled device (not shown). The seat 20 is comprised of soft material which is comfortable but also provides support to the operator. The backrest 22 is an addition to the seat 20 and provides lumbar support and lateral stability for the operator. A worker skilled in the relevant art would appreciate the various ways of forming and configuring the seat 20 and backrest 22. The chair frame 15 contains a footrest 55, which allows the operator's feet to be secured into the chair frame 15.

Figure 4:
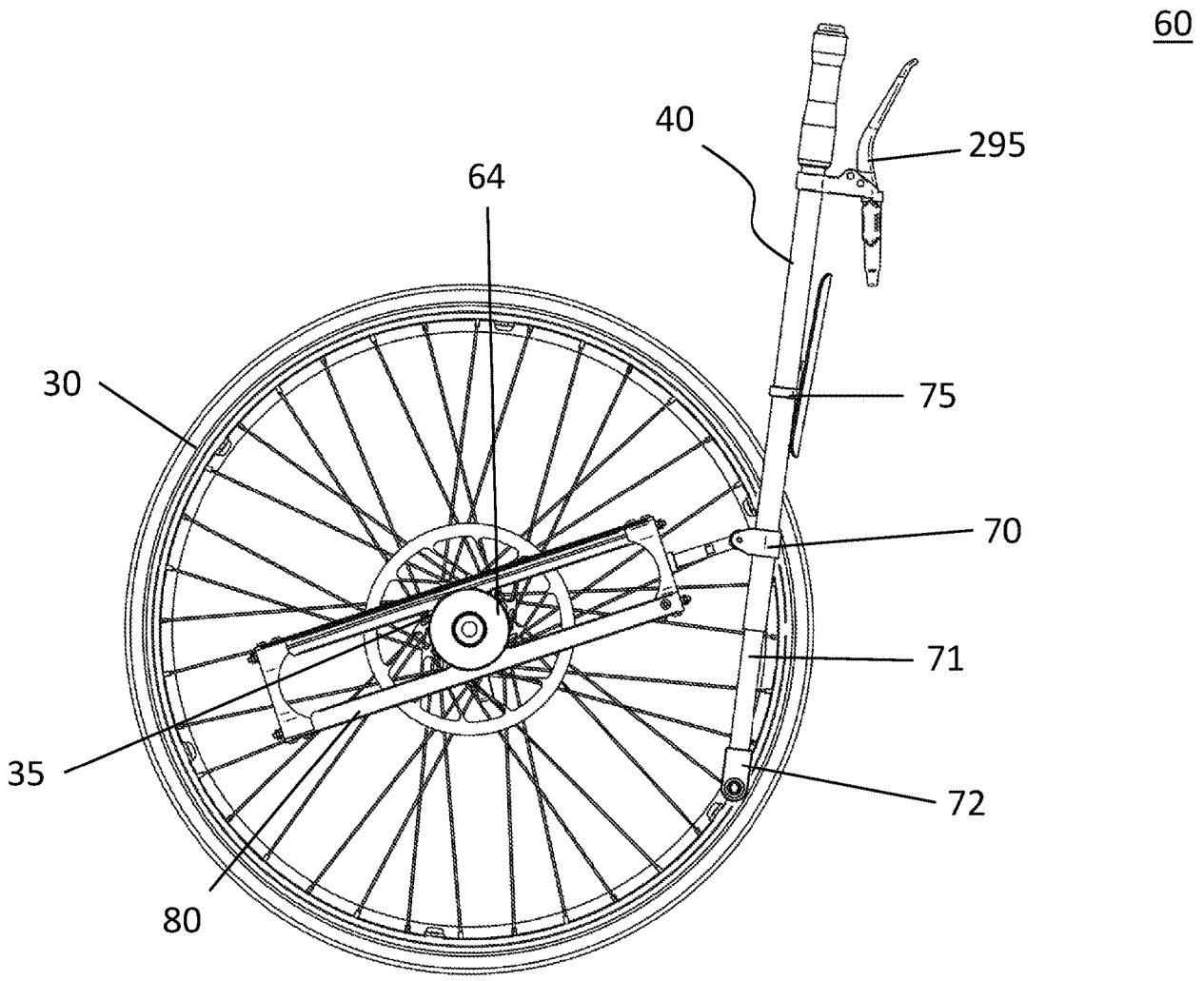
FIG. 4 is an inner view of the propulsion mechanism in association with the wheel in a fixed cable/pulley harp mechanism A, according to one embodiment of the present invention.

With reference to FIG. 4 and according to the preferred embodiment of the present invention the fixed cable/pulley harp mechanism A, the propulsion mechanism 60 is described in greater detail. The propulsion mechanism 60 is primarily comprised of: drive wheels 30; harp drive mechanism 35; and drive lever assembly 40 or 41. The harp drive mechanism 35 is further comprised of: harp frame 80; and, clutch drivers 65. The drive lever assembly is comprised of: a lever shaft 71; steering controller 240 or brake lever 295; a drive ratio handle 75. The preferred embodiment, shown in FIG. 4, employs the fixed cable/pulley mechanism A as the drive mechanism 35. As shown in FIGS. 1 and 2, the propulsion mechanism 60 works in unison, on either side of the hand propelled wheeled vehicle, in a left and right-handed configuration where the left drive lever 40 contains a braking lever 295, and the right drive lever 41 contains a steering controller 240. The harp frame 80 is floating, as it is only attached to the hand propelled wheeled vehicle through the inner and outer clutch drivers, 64 and (not shown), respectively, and the attachment knuckle 70. In one embodiment of the present invention, the drive lever assembly 40 is fixed to the wheelchair frame (not shown) at the drive pivot block 72. As a result of the pivot block 72 the stroke motion applied by the operator is translated into linear motion of the harp drive mechanism, relative to the harp frame, through the use of harp attachment knuckle 70. As the harp frame 80 linearly traverses between the clutch drivers, 64 and 65 (not shown) through a stroke of the drive lever assembly 40, the clutch driver 64, which is affixed to the center of the drive wheel 30, rotates as the harp frame 80 runs across it. The connection point of the harp frame 80 to the drive lever 40 can be modified at the knuckle 70 and is accomplished through the axial movement of the drive ratio handle 75 along the drive lever 40. The adjustment up or down of the connection point alters the range of travel for the harp frame 80, and this variation in effective range acts as a gear change mechanism. A shorter stroke equates to decreased force required to complete the full stroke, along with increased power to the drive wheel 30, and is beneficial for starting off and low speeds. The longer stroke equates to increased range of movement for the harp frame 80, and a better ability to catch up to freewheeling, and apply power to the drive wheel 30 at higher speeds. A single stroke through the functional range of the drive lever assembly 40, translates into a full turn of the driver, which equates to more than one full revolution of the drive wheel 30 at standstill. The rotation of the clutch driver 64 is accomplished through a direct interaction of the harp frame 80 with the clutch driver 64. In one embodiment the direct interaction is accomplished through the use of the fixed cable/pulley mechanism A. The interaction can also be accomplished through: a wraparound tensioned cable/pulley harp mechanism B; rack and pinion harp mechanism C; sprocket and pin rack harp mechanism D; pivoting sprocket and chain mechanism E; linear sprocket and chain mechanism F; and, differential gear mechanism G. These seven designs have a number of key features in common: the drive lever 40, pair of one way clutches, and the drive shaft assembly 90 upon which the clutches engage and disengage. A worker skilled in the relevant art would appreciate the various means of linking the harp 80, or similar linear motion, with the clutch driver 64.

Figure 5:
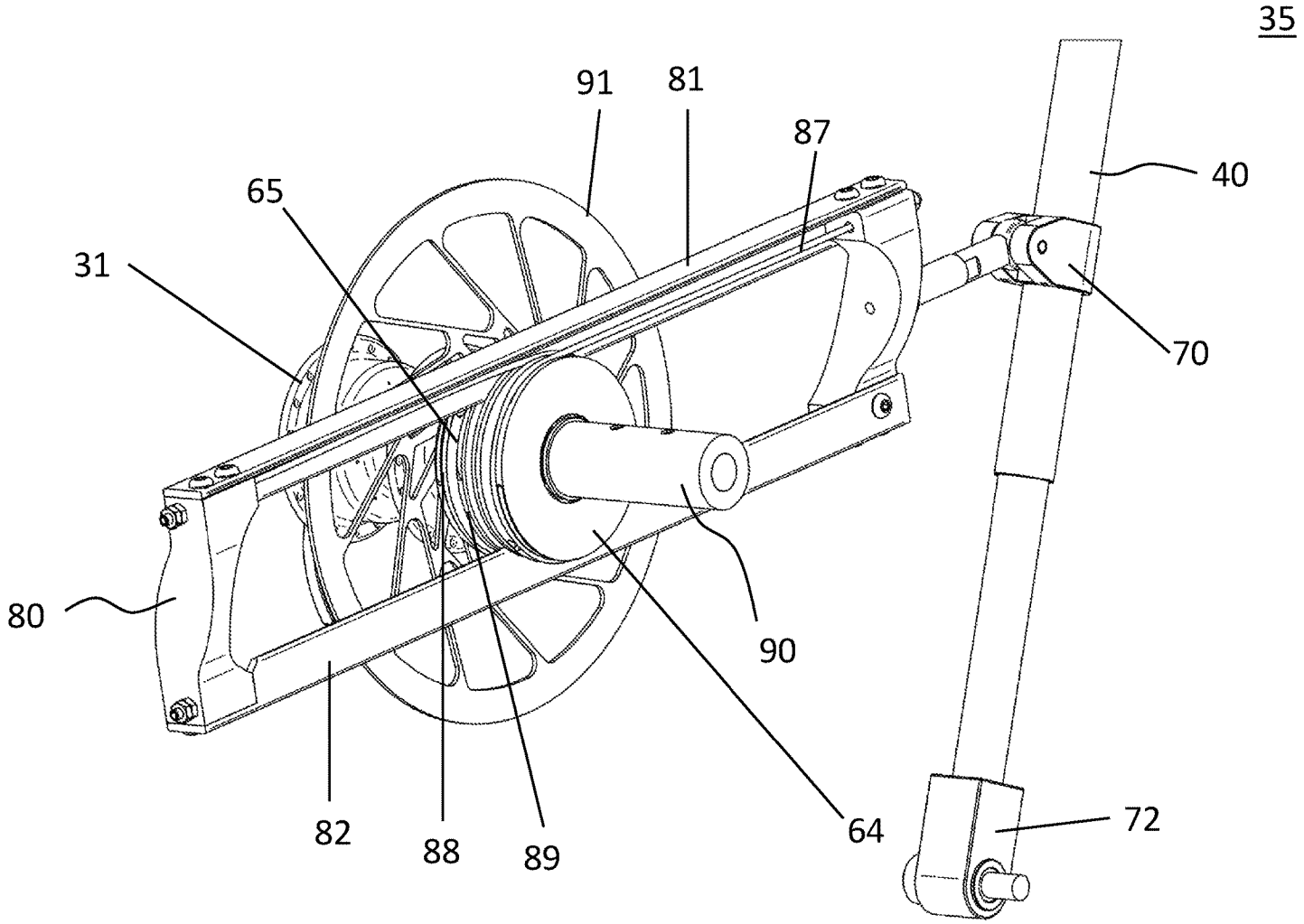
FIG. 5 is an inner perspective view of the propulsion mechanism and harp drive with the wheel hub representing the drive wheel, according to one embodiment of the present invention.
Figure 6:
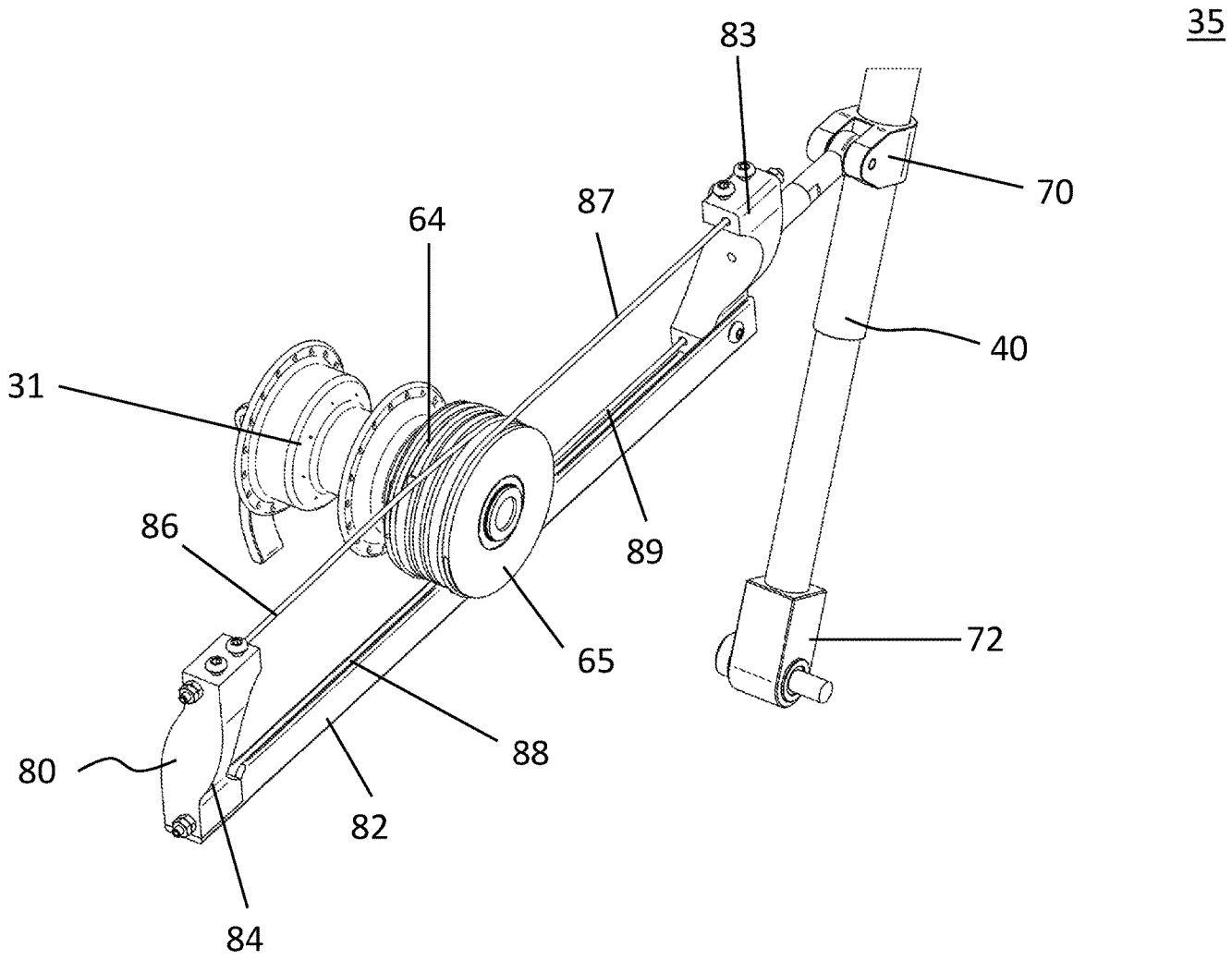
FIG. 6 is a perspective inner view of the propulsion mechanism with the upper plate of the harp frame removed and the wheel hub representing the drive wheel, according to one embodiment of the present invention.

With reference to FIGS. 5, and 6, and according to one embodiment of the present invention, the fixed cable/pulley mechanism A propulsion mechanism 60 is described in greater detail. Once the function of this embodiment of the invention is described, other embodiments of the mechanism will become more clearly understood. In both FIGS. 5 and 6 the drive wheel (not shown) is removed for illustrative purposes only, the wheel hub 31 and brake disc 91 are shown in order to outline the drive wheel location. The harp drive mechanism 35 is comprised of: inner and outer clutch drivers, 64 and 65, respectively; a harp frame 80; inner and outer driving cables, 87 and 88, respectively; and drive shaft assembly 90. The clutch drivers 64 and 65 are embodied in this mechanism as pulleys. The inner and outer driving cables, 87 and 88, couple the harp frame 80 onto the inner and outer clutch drivers, 64 and 65. The coupling translates the linear motion of the harp frame 80 into rotational motion of the inner and outer clutch drivers 64 and 65, which is transferred onto the drive shaft assembly 90. The harp 80 is a free floating unit that moves linearly across the inner and outer clutch drivers 64 and 65. Forward and backward linear movement of the harp 80 is driven by the drive lever 40. The operator pushes and pulls the drive lever 40 which moves the harp frame 80 forward and backwards, respectively. In the present embodiment, the drive lever 40 is attached to the chair (not shown) at the pivot block 72, and as a result, a harp attachment knuckle 70 is required to ensure that the linear force provided by the operator is translated to linear motion onto the harp 80. A worker skilled in the relevant art would appreciate the various means of connecting the drive lever assembly 40 to the harp frame 80. With specific reference to FIG. 6, the propulsion mechanism 60 is shown with the upper beam of the harp frame 80 removed. In this configuration, the inner and outer driving cables 87 and 88, respectively, are shown coupled to the inner and outer clutch drivers 64 and 65, respectively, and fixed onto the harp frame 80. The front end of the inner driving cable 87 and the rear end of the outer driving cable 88 are attached to the inner edges of the harp frame 80. The inner and outer drive cables 87 and 88 then wrap around, and are affixed to, the inner and outer clutch drivers, 64 and 65, respectively. In the fixed cable/pulley mechanism embodiment, the inner and outer cables, 87 and 88 are complemented by two inner and outer idling cables, 86 and 89, respectively. The inner idling cable 86 is attached at the rear of the harp frame 80, opposite to the inner driving cable 87, and at its other end is affixed to, and wrapped around the inner clutch driver 64. The outer idling cable 89 is attached at the front of the harp frame 80, opposite to the outer driving cable 88, and at its other end is affixed to, and wrapped around the outer clutch driver 65. The function of anchoring the driving and idling cables to the clutch drivers in the fixed cable/pulley mechanism is to eliminate the potential of cable slippage around the clutch drivers. The inner and outer drivers, 64 and 65, respectively, are adjacent and set onto the drive shaft assembly 90. The harp frame 80 is set between the inner and outer clutch drivers, 64 and 65 with the upper and lower beams, 81 and 82, respectively, containing integral rails which align with each other and are set between the clutch drivers, 64 and 65. The beams, 81 and 82, act as guides, allowing the harp frame 80 to run in alignment with the clutch drivers, 64 and 65. The front and rear pillars, 83 and 84, respectively, are formed to align the beams, 81 and 82. A worker skilled in the relevant art would appreciate the various means of constructing a harp frame 80 wherein the upper and lower beams, 81 and 82, respectively, contain rails or similar protrusions that align.

Figure 7A:
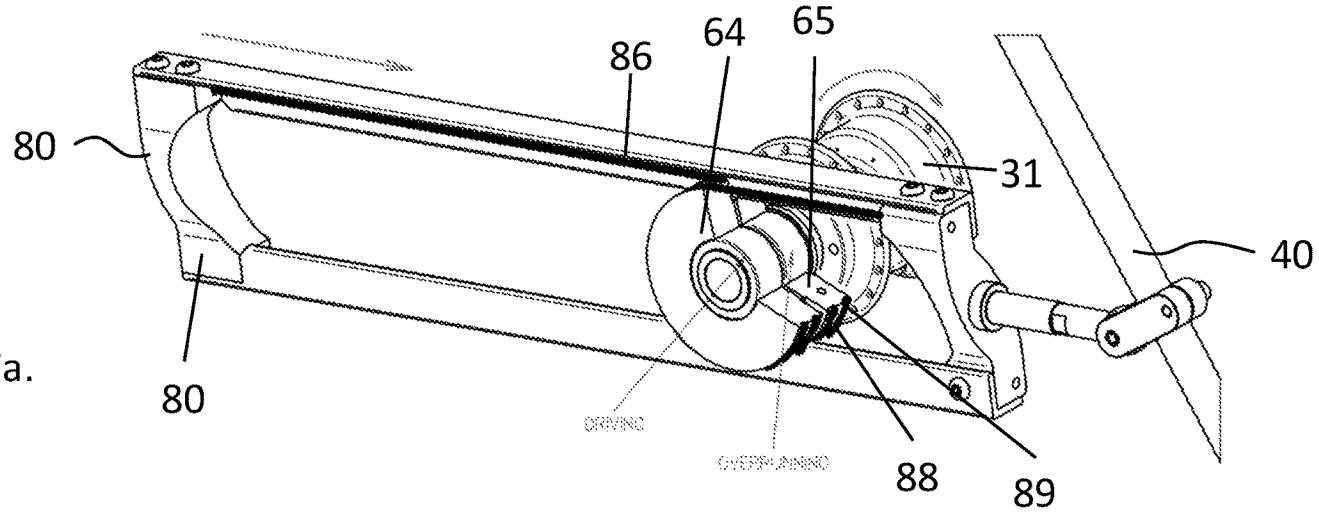
FIG. 7*a* is an illustrative image of the harp drive mechanism operating on the forward (push) stroke, according to one embodiment of the present invention.
Figure 7B:
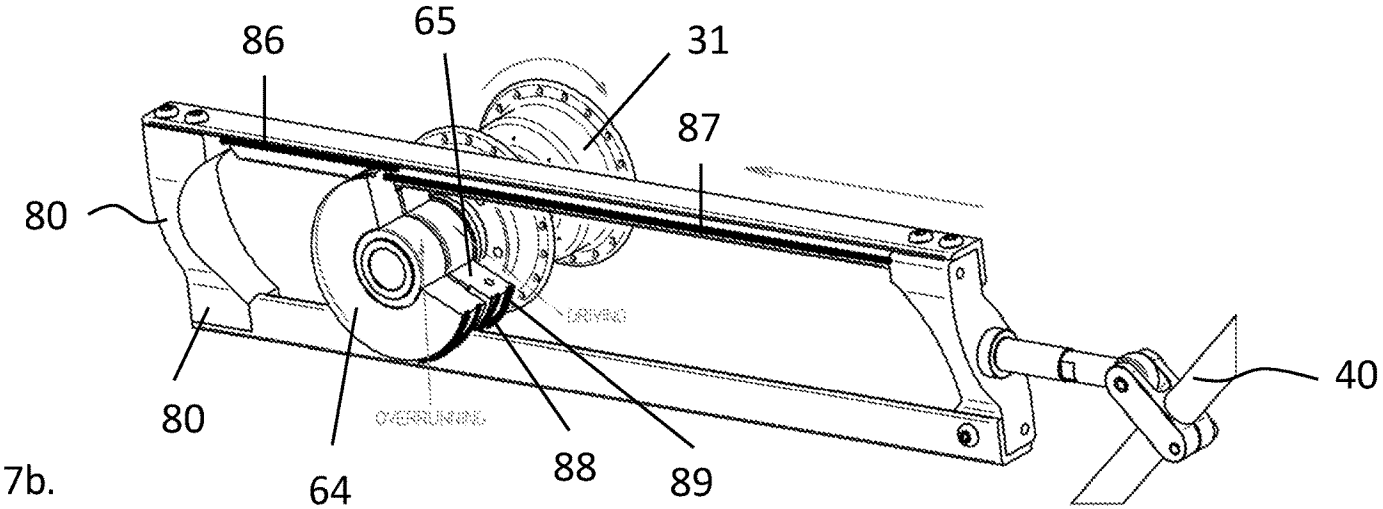
FIG. 7*b* is an illustrative image of the harp drive mechanism operating on the return (pull) stroke, according to one embodiment of the present invention.

With reference to FIG. 7, the propulsion mechanism of the harp drive mechanism 35 is shown in greater detail. FIG. 7*a* describes the action of the harp drive mechanism 35 when the operator is pushing the drive lever 40. FIG. 7*b* describes the action of the harp drive mechanism 35 when the operator is pulling the drive lever 40. As the harp frame 80 moves forward or backward, the inner and outer driving cables, 87 and 88, respectively, and the inner and outer idling cables, 86 and 89, respectively, partially wind and unwind around corresponding clutch drivers, causing the drivers to rotate. As described in FIG. 7*a*, when the operator pushes the drive lever 40, the harp frame 80 moves forward and passes between the inner and outer clutch drivers, 64 and 65, respectively. As the harp 80 moves forward, the inner clutch driver 64 is engaged with the drive shaft (not shown) and is driving the wheel hub 31 forward, as the inner clutch driver 64 is rotated forward by unwinding of the inner driving cable 87. The outer clutch driver 65, is being rotated backwards by the unwinding of the outer idling cable 89 and is overrunning the drive shaft (not shown), thus transferring no rotation to the wheel hub 31. As described in FIG. 7*b*, when the operator pulls the lever assembly 40, the harp frame 80 moves backward guided by the upper and lower beams, 81 and 82, respectively. As the harp frame 80 moves backward, the outer clutch driver 65 is engaged with the drive shaft (not shown) and is driving the drive wheel, partially shown as a wheel hub 31, forward, as the outer clutch driver 65 is rotated forward by the unwinding of the outer driving cable 88. The inner clutch driver 64, is being rotated backwards by the unwinding of the inner idling cable 86 and is overrunning the drive shaft (not shown), thus transferring no rotation to the wheel hub 31. The alternate directions in which the driving cables 87 and 88, and idling cables 86 and 89, are wound around the clutch drivers, 64 and 65, is responsible for the contra-rotating action.

Figure 8:
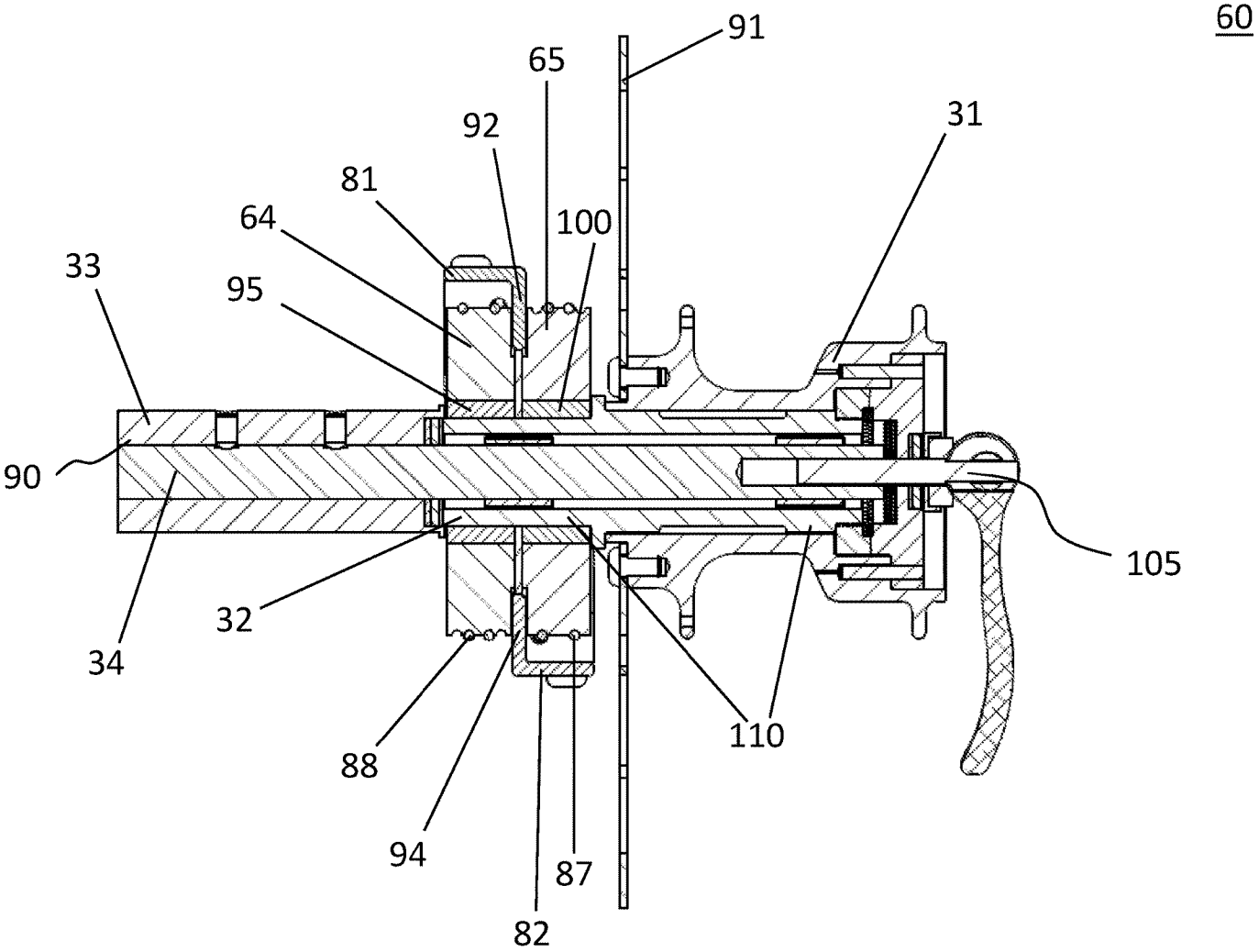
FIG. 8 is a cross-sectional view of the propulsion mechanism, according to one embodiment of the present invention.

With reference to FIG. 8, and according to one embodiment of the present invention, a cross-sectional view of the propulsion mechanism 60 is described in greater detail. For clarity, the drive lever is not shown, and the drive wheel (not shown) is represented in the cross-section with the wheel hub 31 and disc brake 91. The drive shaft assembly 90 is primarily comprised of: the drive shaft 32, the fixed axle 34, and axle mounting adaptor 33. The axle mounting adaptor 33 secures the fixed axle 34 to the chair frame (not shown) as the drive wheel propulsion mechanism 60 rotates about the fixed axle 34. As such, the left drive wheel (not shown) of the propulsion mechanism 60 is independent from the right drive wheel (not shown). The coupling lever assembly 105 enables the wheel hub 31 to be coupled to the drive shaft 32, and in its locked position, rotation of the drive shaft 32 around the fixed axle 34 rotates the wheel hub 31 forward. The inner and outer one way drive clutches, 95 and 100, respectively, are mated to the inner and outer clutch drivers, 64 and 65, respectively, and mount onto the drive shaft 32. The inner and the outer one way drive clutches, 95 and 100 are mounted to drive in the same direction (forward). As such when the inner one way drive clutch 95 is driving, the outer one way drive clutch 100 is overrunning (idling), and vice versa, as the harp and cables cause both drivers to run in opposite directions. The inner and outer drive cables, 87 and 88, respectively, wrap around the inner and outer clutch drivers, 64 and 65, respectively, causing the inner and outer drivers, 64 and 65, to contra-rotate as the harp 80 moves. The rotation of the inner and outer clutch drivers, 64 and 65, respectively, is translated into unidirectional rotation of the drive shaft 32, through the inner and outer one way drive clutches, 95 and 100, respectively. The drive shaft 32 rotates around the fixed axle 34, which is aided by bearings 110. The harp frame, shown through the upper and lower harp beams 81 and 82, respectively, is guided between the inner and outer clutch drivers, 64 and 65, respectively. The upper and lower harp beams, 81 and 82 act as guide rails, allowing the harp frame, to maintain alignment with the inner and outer clutch drivers, 64 and 65.

When the coupling lever assembly 105 is in the locked position, the wheel hub 31 and the drive shaft 32 are locked together. In this locked configuration, rotation of the drive shaft 32, translates to the wheel hub 31 and drive wheel (not shown). When the coupling lever assembly 105 is in the unlocked position, the wheel hub 31 and the drive shaft 32 are disconnected, allowing the wheel hub 31 to rotate freely and independently of the drive shaft 32. As a result, the operator has the ability to maneuver the wheelchair through direct manipulation of the hand rings affixed to the drive wheel 30.

Figure 9:
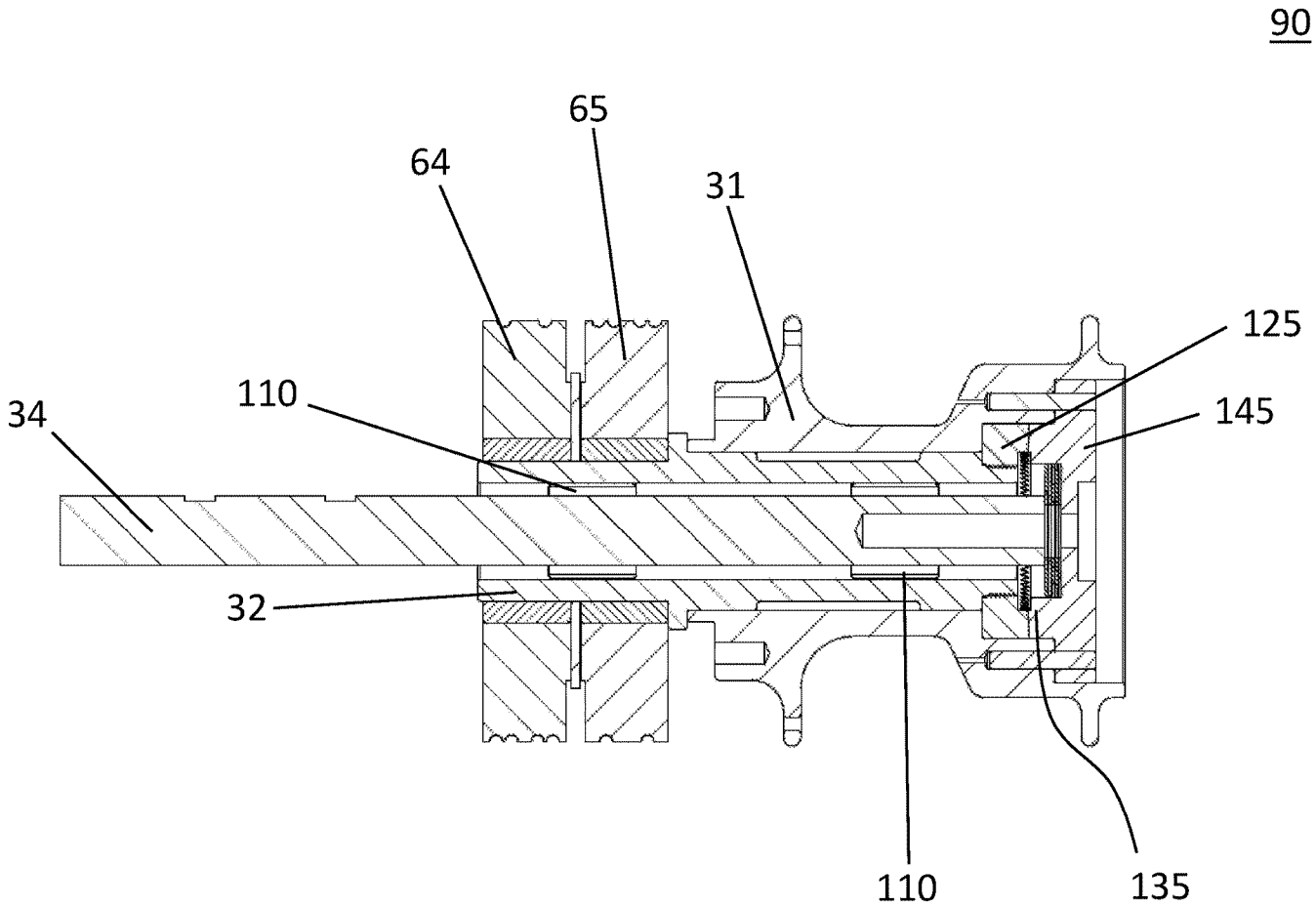
FIG. 9 is a cross-sectional view outlining the interaction between the spoked wheel hub 31 and the drive shaft 32, according to one embodiment of the present invention.

With reference to FIG. 9, and according to one embodiment of the present invention, a cross-sectional view, outlining the interaction between the wheel hub 31 and the drive shaft 32, is described in greater detail. For clarity, only the drive shaft assembly 90 is shown, and comprises: the drive shaft 32, fixed axle 34, hirth coupling assembly 135, wheel hub 31; and clutch drivers 64 and 65. The fixed axle 34 attaches to the chair frame (not shown) and does not rotate. The forward rotation of the wheel hub 31 is dependent on its connection with the drive shaft 32 through the hirth coupling assembly 135. In the coupling's locked configuration, rotation of the wheel hub 31 occurs, as the drive shaft 32 is being rotated by the inner and outer clutch drivers, 64 and 65, respectively when the drive lever (not shown) is manipulated. In the unlocked configuration, the wheel hub 31 is disengaged from the drive shaft 32 at the hirth coupling 135, and can freely rotate around the drive shaft 32. In this configuration, the harp drive mechanism (not shown) does not affect the rotation of the wheel hub 31. Any rotation placed upon the drive shaft 32 by the clutch drivers, 64 and 65, is not transferred to the wheel as the drive shaft 32 rotates freely inside the hub 31. In the unlocked configuration, the operator can directly rotate the drive wheels (not shown) forward or backward as in a conventional wheelchair, without affecting the harp drive mechanism. The unlocked configuration would be used by the operator to move backward from an obstruction, or when attempting to maneuver in small spaces.

Figure 10B:
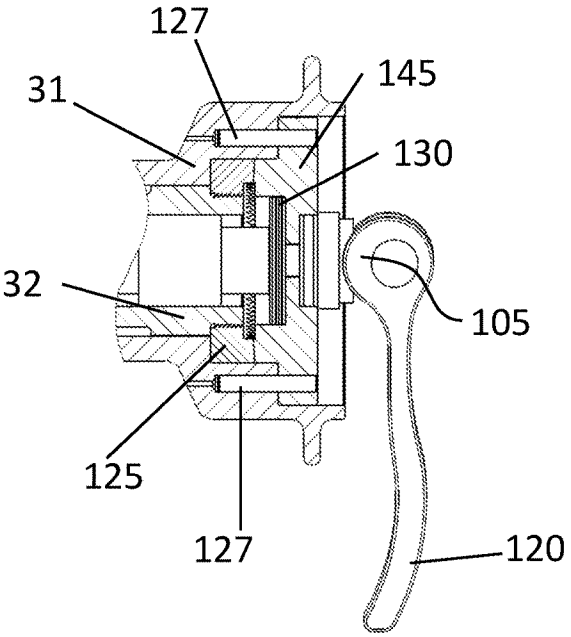
FIG. 10*b* is a cross-sectional view of the drive coupling lever in the locked (forward drive) position, according to one embodiment of the present invention.
Figure 10C:
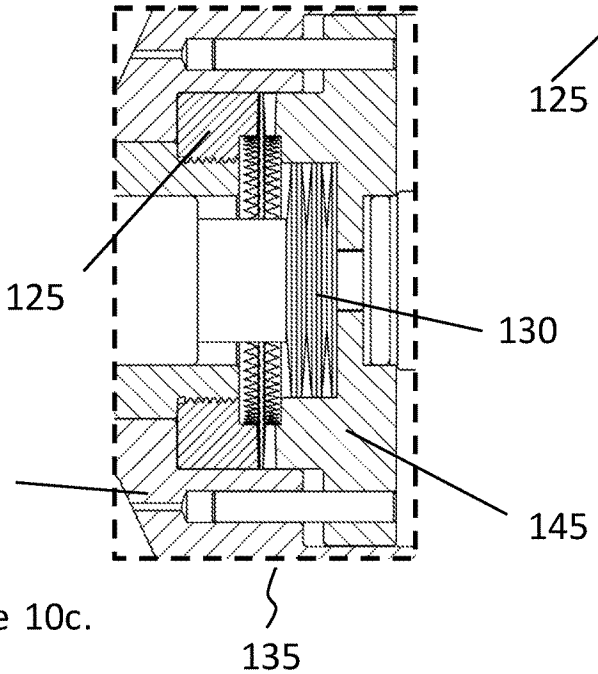
FIG. 10*c* is a magnified cross-sectional view of the hirth coupling in the unlocked (freewheeling) position, according to one embodiment of the present invention.
Figure 10A:
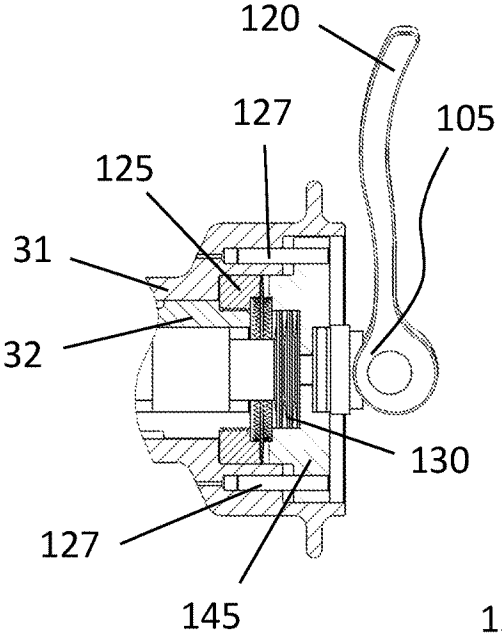
FIG. 10*a* is a cross-sectional view of the drive coupling lever in the unlocked (freewheeling) position, according to one embodiment of the present invention.

With reference to FIGS. 10*a*, 10*b*, and 10*c*, and according to one embodiment of the present invention, a cross-sectional view of the coupling lever assembly 105 is described in greater detail. The coupling lever assembly 105 is primarily comprised of: a locking/unlocking lever 120; driving hirth coupling member 125; driven hirth coupling member 145; Belleville spring stack 130; and drive transfer pins 127. With specific reference to FIG. 10*c*, the hirth coupling assembly 135 is shown in a magnified image of FIG. 10*a*. The hirth coupling 135 is comprised of driving and driven hirth coupling members, 125 and 145, respectively, which lock together. A worker skilled in the relevant art would appreciate the mode of action of a hirth coupling. The driven hirth coupling member 145 is coupled to the wheel hub 31 through drive transfer pins 127, as such, the driven hirth coupling member 145 functions to engage or disengage the wheel hub 31 from the drive shaft 32. With specific reference to FIG. 10*a*, the coupling lever assembly 105 is shown in its unlocked position. In the unlocked position, the Belleville spring stack 130 positively separates the driving and driven hirth coupling members, 125 and 145, thereby disengaging the drive shaft 32 from the wheel hub 31. The spring stack 130 is in place to separate the hirth coupling. In the unlocked configuration, the wheel hub 31 is free to rotate around the drive shaft 32, as the unlocking disconnects the rotation of the drive shaft 32 from the wheel hub 31. With specific reference to FIG. 10*b*, the coupling lever assembly 105 is shown in its locked position. In the locked position, the lever 120 forces the driven hirth coupling member 145 onto the driving hirth coupling member 125, engaging the hirth coupling 135, thereby locking the driven hirth coupling member 145 to the drive shaft 32. The drive transfer pins 127 mate the driven birth coupling member 145 with the wheel hub 31, thereby transferring the rotation from the drive shaft 32 to the wheel hub 31. The Belleville spring stack 130 is compressed, and the mechanism is locked in place by the coupling lever 105, as the spring stack 130 only provides enough force to separate the hirth coupling when the lever 105 is in the unlocked position. This configuration is necessary, as it allows the operator to lock or unlock the coupling lever 105 at any time, regardless of the relative position the wheel hub 31 and drive mechanism 35. The coupling is designed in this embodiment of the invention to feature a short range of travel that corresponds to the allowable movement of the lever 105.

Figure 11:
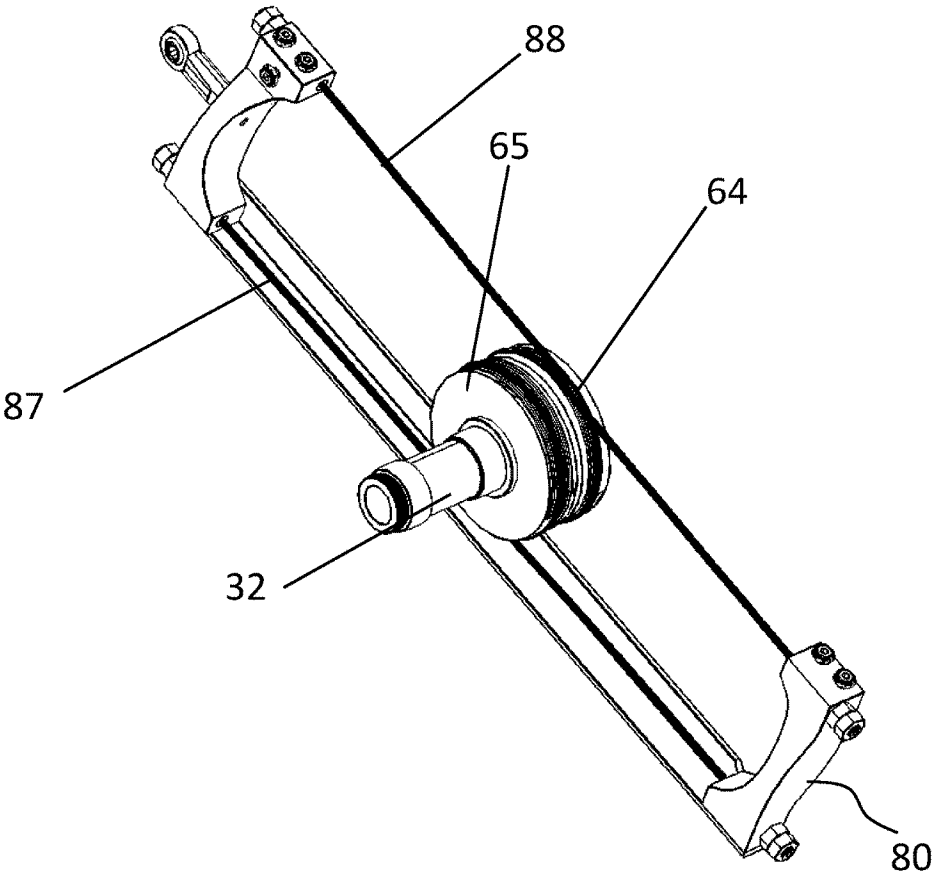
FIG. 11 is an outer perspective view of a wraparound tensioned cable/pulley harp drive mechanism B, according to another embodiment of the present invention.

With reference to FIG. 11, and according to one embodiment of the present invention, the wraparound tensioned cable mechanism B is described in greater detail. The wraparound tensioned cable mechanism is another embodiment of the harp drive mechanism 35 that is used within the propulsion mechanism (not shown) of the hand propelled wheeled vehicle. As stated above, this is another means of converting linear movement of the harp frame 80 into rotational movement of the inner and outer clutch drivers, 64 and 65, respectively. In this embodiment, the inner and outer drive cables, 87 and 88, respectively, are comprised of a single cable and the clutch drivers 64 and 65 are embodied as pulleys. For ease of reference, the function of the harp drive cable mechanism will be described with regards to the inner drive cable 87 wrapping around the inner clutch driver 64. The same mechanism occurs with the outer drive cable 88 wrapping around the outer clutch driver 65. One end of the inner drive cable 87 is attached to the harp frame 80; it is then wound around the inner clutch driver 64 and attached at its other end to the harp frame 80 at sufficiently high tension to eliminate slippage. As the harp frame 80 moves in a linear direction, the inner drive cable 87 partially winds and unwinds around the inner clutch driver 64, causing the inner clutch driver 64 to rotate, driving or overrunning the drive shaft 32.

Figure 12A:
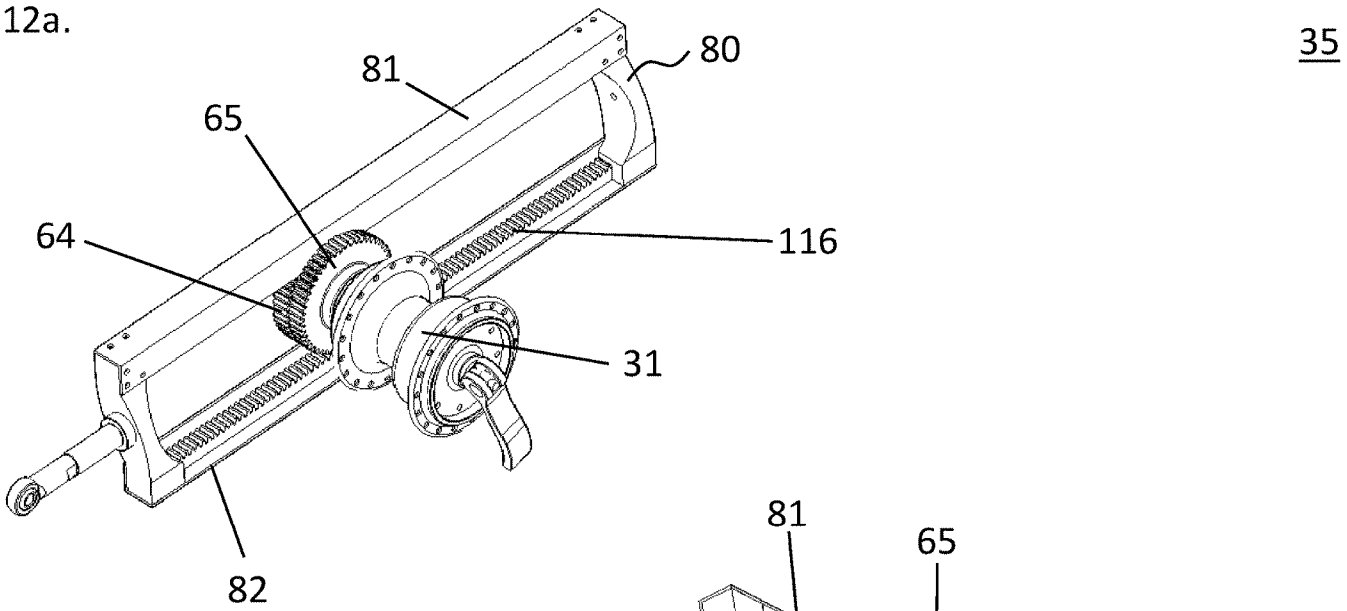
FIG. 12*a* is an outer perspective view of the rack and pinion harp drive mechanism C, according to another embodiment of the present invention.
Figure 12B:
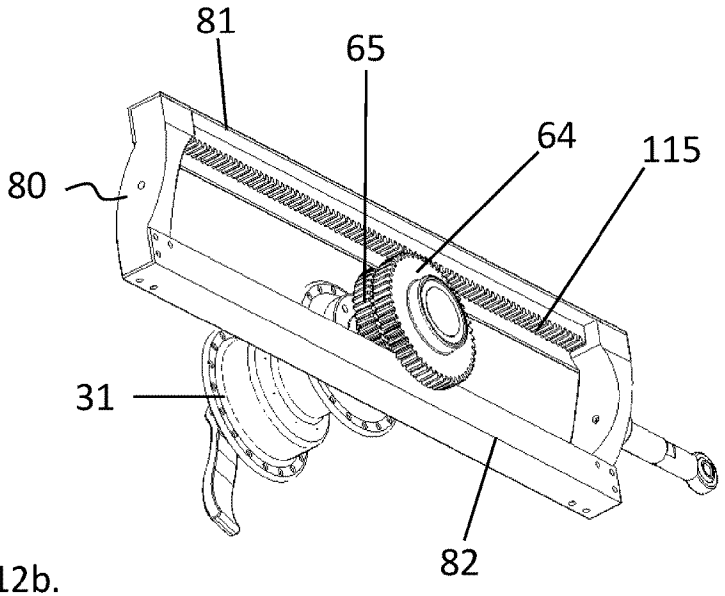
FIG. 12*b* is a lower inner perspective view of a rack and pinion harp drive mechanism C, according to another embodiment of the present invention.

With reference to FIGS. 12*a* and 12*b*, and according to one embodiment of the present invention, a rack and pinion harp drive mechanism C is described in greater detail. The mechanism C is another embodiment of the harp drive mechanism 35 that is used within the propulsion mechanism (not shown) of the hand propelled wheeled vehicle. As stated above, it is another means of converting linear movement of the harp frame 80 into rotation of the inner and outer clutch drivers, 64 and 65, respectively. In this embodiment the rack and pinion drive mechanism C employs a gear system to convert the linear movement of the harp frame 80 into rotational movement of the inner and outer clutch drivers, 64 and 65, and subsequently, the wheel hub 31. The inner and outer clutch drivers, 64 and 65, respectively, are comprised of pinion gears, and are engaged with the upper and lower linear gear racks, 115 and 116, set within the upper and lower harp beams, 81 and 82, of the harp frame 80. As the harp 80 is moved by the drive lever (not shown) it passes around the clutch drivers, 64 and 65, and the teeth of the upper and lower gear racks, 115 and 116, engage with the clutch drivers, 64 and 65, causing one to drive the wheel hub 31 and one to overrun. On the push stroke, the lower gear rack 116 is driving the wheel, and on the pull stroke the upper gear rack 115 is driving the wheel.

Figure 13:
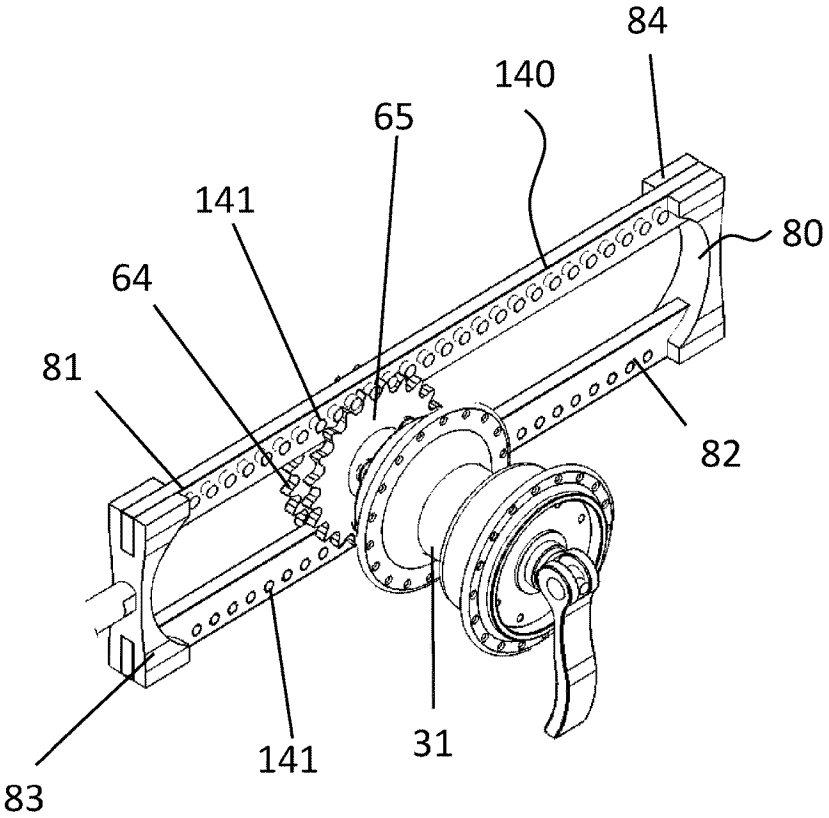
FIG. 13 is a perspective view of a sprocket and pin rack harp drive mechanism D, according to another embodiment of the present invention.

With reference to FIG. 13, and according to one embodiment of the present invention, the sprocket and pin rack harp mechanism D is described in greater detail. The mechanism D is another embodiment of the harp drive mechanism 35 that is used within the propulsion mechanism (not shown) of the hand propelled wheeled vehicle. As stated above, this is another means of converting linear movement of the harp frame 80 into rotational movement of the inner and outer clutch drivers, 64 and 65, respectively. In this embodiment an integral pin rack system converts the linear movement of the harp frame 80 into rotational movement of the inner and outer clutch drivers, 64 and 65, respectively, and the wheel hub 31. The inner and outer drivers, 64 and 65, respectively, are comprised of sprocket gears, which engage with the pin rack 140 set within the upper and lower harp beams, 81 and 82, of the harp frame 80. It is this interaction of the pin rack 140 moving forwards and backwards while the harp pins 141 are engaged with the teeth of the inner and outer clutch drivers, 64 and 65, respectively, that allows the mechanism to rotate the wheel hub 31. Additionally the front and rear harp pillars, 142 and 143, respectively, are formed differently than the pillars of the previous harp frame 80. The pin racks 140 are aligned between the inner and outer clutch drivers, 64 and 65, respectively, necessitating a symmetrical front and rear pillar to maintain alignment of the harp pins 141.

Figure 14:
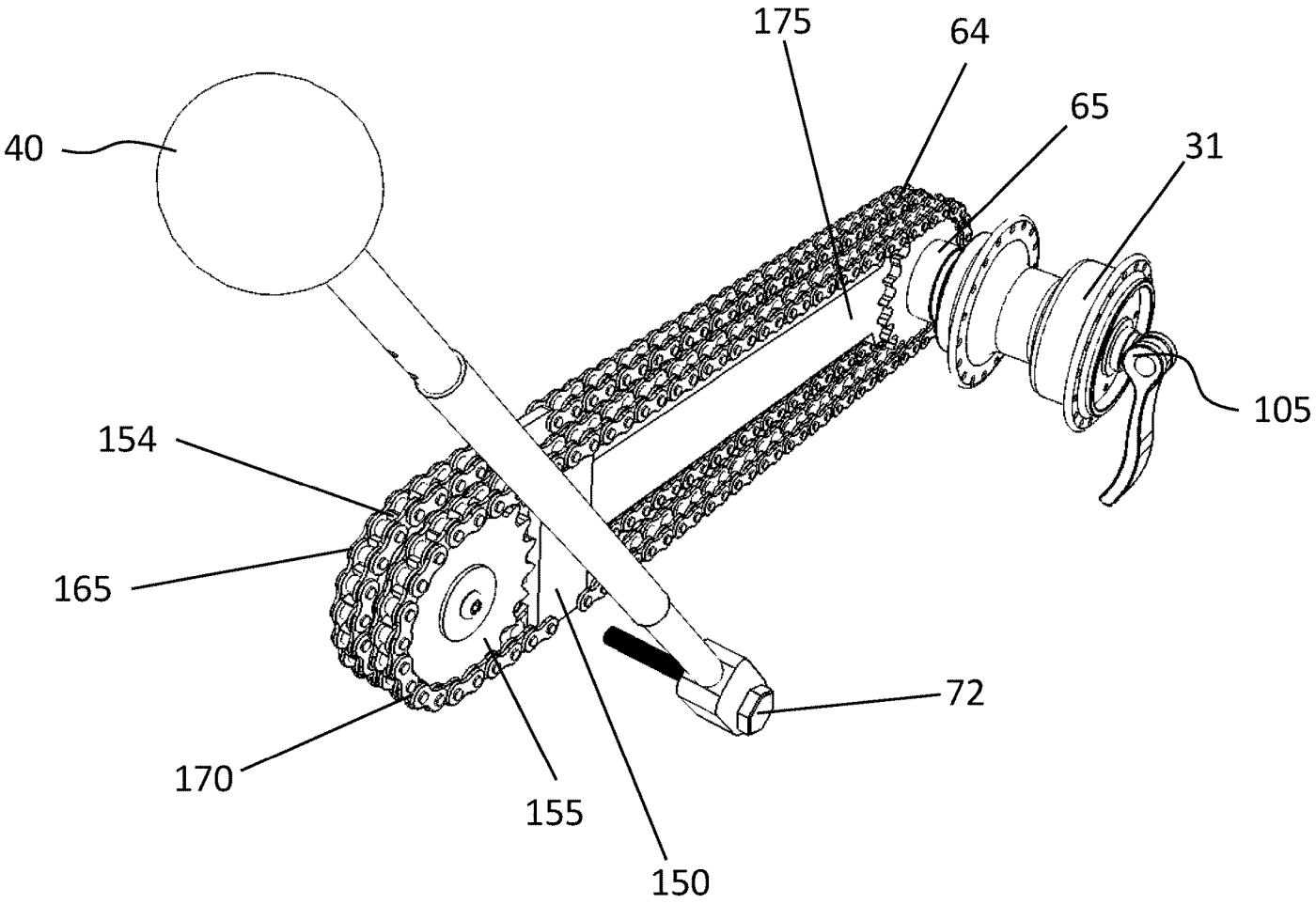
FIG. 14 is an outer perspective view of the floating rail sprocket and chain mechanism F, according to another embodiment of the present invention.

With reference to FIG. 14, and according to another embodiment of the present invention, the floating sprocket and chain mechanism F is described in greater detail. The floating sprocket and chain mechanism F is another embodiment of the harp drive mechanism 35 that is used within the propulsion mechanism (not shown) of the hand propelled wheeled vehicle. As stated above, this is another means of converting linear movement into rotational movement of the inner and outer clutch drivers, 64 and 65, respectively. In this case the harp frame 80 is substituted by a series of chains and sprockets containing: a drive block 150, floating support rail 175, inner and outer clutch drivers, 64 and 65, respectively, embodied as sprockets; inner and outer idler sprockets, 165 and 155, respectively, and inner and outer drive chains, 165 and 170, respectively.

The floating support rail 175 is the backbone of mechanism F, as it supports the drive block 150, the inner and outer clutch drivers, 64 and 65, respectively, and the inner and outer idler sprockets, 154 and 155, respectively. A drive block 150 runs along the support rail 175 from the inner and outer idler sprockets, 154 and 155, to the inner and outer clutch drivers, 64 and 65. The inner drive chain 165 is fixed to the top of the chain driver 150, wraps around the inner idler sprocket, 154, and around the inner clutch driver, 64, and terminates the loop by attaching to the top of the drive block 150. The outer drive chain 170 is fixed to the bottom of the drive block 150, wraps around the outer idler sprocket 155 and around the outer clutch driver 65, and terminates the loop by attaching to the bottom of the chain driver 150. The drive lever assembly 40 is connected to the drive block 150. The block 150 moves across the support rail 175 as the operator pushes and pulls the drive lever assembly 40. In this arrangement, the lateral movement of the chain block 150 across the support rail 175 causes the inner and outer chains, 165 and 170, to move along their respective looped paths causing the inner and outer clutch drivers, 64 and 65, to rotate along with the inner and outer idler sprockets, 154 and 155. The rotation of the inner and outer clutch drivers, 64 and 65, is translated into forward rotation of the wheel hub 31. The floating support rail 175 and mechanism float freely, as with the harp frame 80, as the unit pivots about the fixed axle 34.

Figure 15:
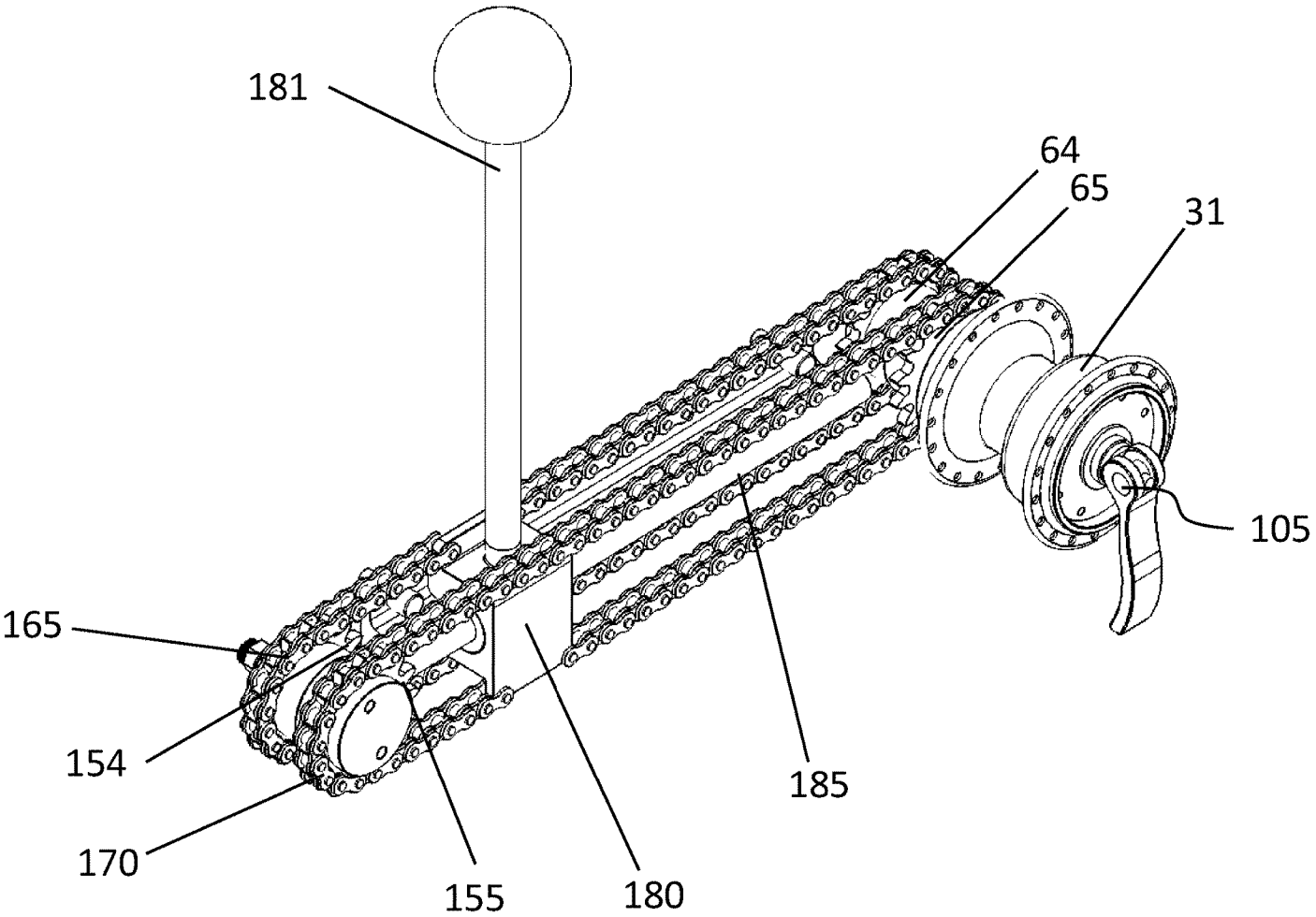
FIG. 15 is an outer perspective view of the fixed rail sprocket and chain mechanism G, according to another embodiment of the present invention.

With reference to FIG. 15, the fixed sprocket/chain mechanism G is described. Mechanism G functions in a manner identical to mechanism F. In this case the harp frame 80 is substituted by a drive block 150, a chain drive handle 181, fixed support rail 185, the clutch drivers, 64 and 65, embodied as sprockets, inner and outer idler sprockets, 154 and 155, respectively; and inner and outer drive chains, 165 and 170, respectively. Where the chain drive handle 181 moves the drive block 150 along the fixed support rail 185 and actuates the inner and outer drive chains, 165 and 170, respectively, are engaged with the sprocket series. The difference between the fixed and floating versions of the sprocket and chain assemblies F and G, lies in the connection point between either the drive lever 40 or the chain drive handle 181, and in the path followed by the chain guides. In mechanism G, the support rail 185 is fixed at multiple points, remaining stationary, and attached to the chair frame (not shown), and the chain drive lever 181 contains a handle and drive block 150 connected directly to the chains. The operator actuates the chain drive lever 181 linearly backwards and forwards, driving the inner and outer clutch drivers, 64 and 65 respectively, via the inner and outer drive chains, 165 and 170, respectively. In this mechanism, the drive lever 181 is fixed to the drive block 150, not to the frame, and does not pivot around a fixed point. The relationship between the inner and outer clutch drivers, 64 and 65, as they drive or overrun the drive shaft (not shown) to rotate the wheel hub 31 forward, is maintained within the framework of the propulsion mechanism, the same as the other variants.

Figure 16:
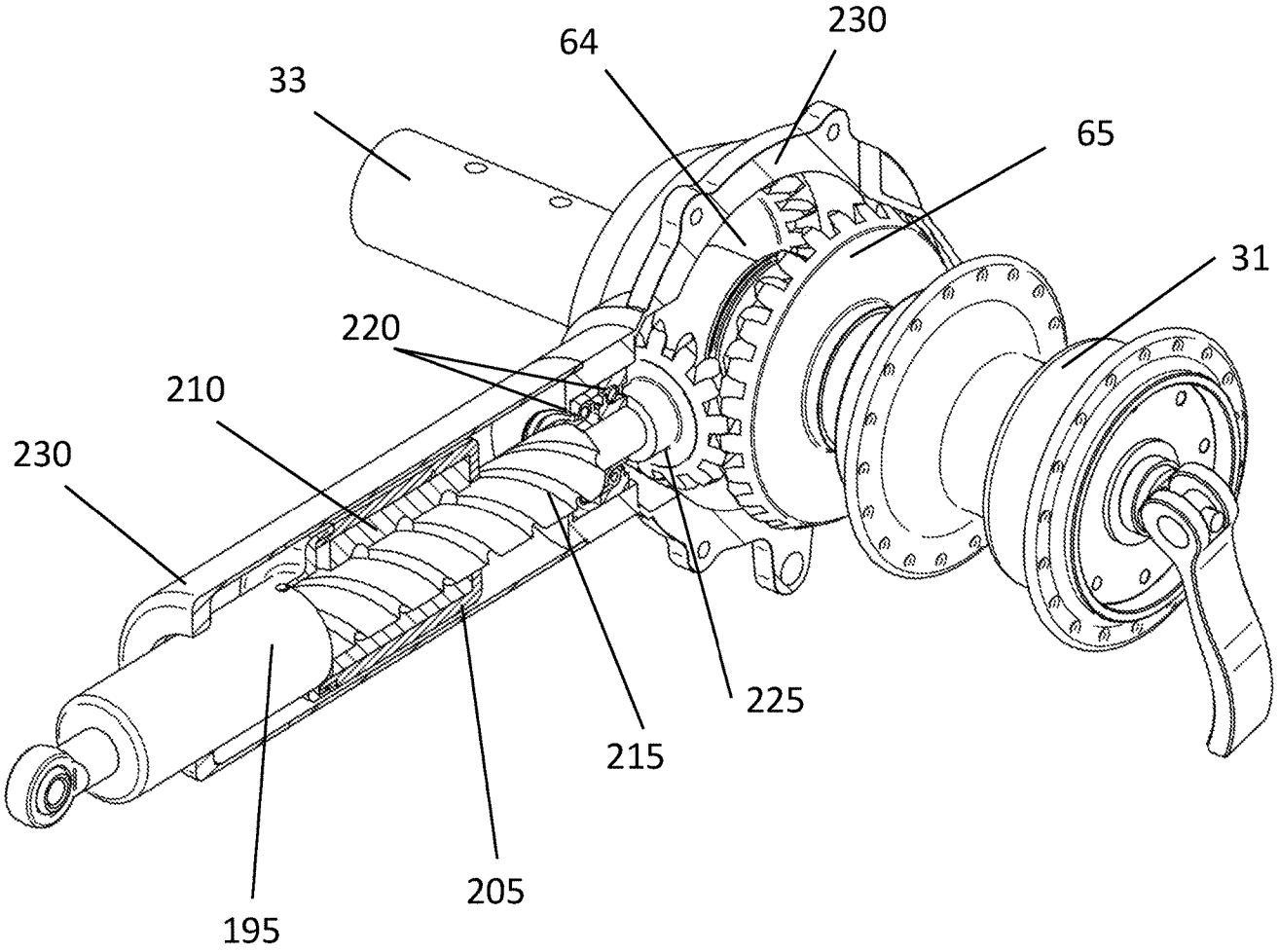
FIG. 16 is a perspective view of the ballscrew/differential gear drive mechanism E with the differential housing and outer sleeve housing cut away, according to another embodiment of the present invention.
Figure 17:
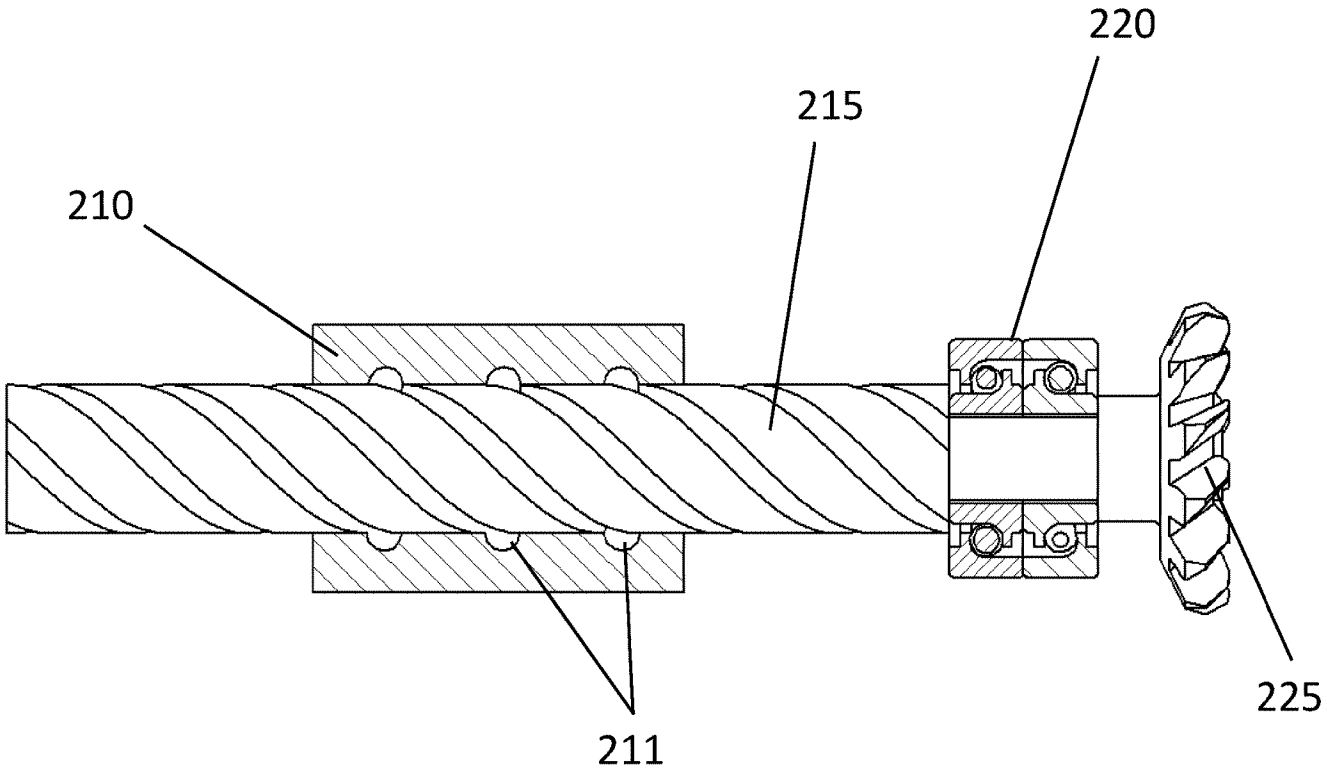
FIG. 17 is a cross-sectional diagram of the ball nut assembly of the ballscrew/differential gear drive mechanism E, according to another embodiment of the present invention.

With reference to FIGS. 16, and 17, and according to one embodiment of the present invention, the ballscrew/differential gear mechanism E is described in greater detail. The ballscrew/differential mechanism E is another embodiment of the harp drive mechanism 35 that is used within the propulsion mechanism (not shown) of the hand propelled wheeled vehicle. As stated above, this is another means of converting linear movement of an assembly similar to the harp frame 80 into rotational movement of the inner and outer clutch drivers, 64 and 65, respectively. The wheel hub 31 and the fixed axle 34 are shown as reference points to orient the ballscrew/differential gear mechanism E within the propulsion mechanism. In this embodiment, the harp drive mechanism 35 is replaced with a ball screw/differential gear mechanism E, comprised of: the ball nut drive sleeve 195, ball nut 210, ballscrew 215, ballscrew bearings 220, driving bevel gear 225, mechanism housing 230, and clutch drivers 64 and 65. In this mechanism, the clutch drivers, 64 and 65, are embodied as differential gears. The housing 230 protects the running components of the mechanism from contaminants, while sealing in lubricant. With specific reference to FIG. 16, the ballscrew/differential gear mechanism is shown in greater detail. The ball nut 210 is set within the ball nut drive sleeve 195 and this assembly is moved axially along the ballscrew 215 by interaction with the drive lever (not shown). The ballscrew is fixed at one end through ballscrew bearings 220 to the mechanism housing 230. The linear movement of the ball nut 210 causes the ballscrew 215 and the attached driving bevel gear 225 to rotate, which subsequently rotates the inner and outer clutch drivers, 64 and 65, respectively. The drivers, 64 and 65, are contra-rotating in an identical fashion to the drivers in the variants having a harp frame 80, as they interact with the drive shaft (not shown) to rotate the wheel hub 31 forward.

With specific reference to FIG. 17, the ball nut 210 and ballscrew 215 is schematically shown. Ball bearings 211 are located within the ball nut 210, and are positioned within the grooves of the ballscrew 215, a worker skilled in the relevant art will appreciate the various means of constructing and utilizing a ballscrew assembly. The helix of the grooves causes the ballscrew 215 to rotate as the ball nut 210 moves axially along it. The driving bevel gear 225 is fixed to the ballscrew 215, and transfers its rotation to the inner and outer clutch drivers, 64 and 65 respectively. As the ball nut 210 moves towards the driving bevel gear 225, the gear is rotated clockwise, when the ball nut 210 moves away from the driving bevel gear 225, it rotates counter-clockwise. This contra-rotating action is the key to the push pull of the driving lever (not shown) harnessing the one-way clutches to achieve unidirectional rotation output from a reciprocating linear input.

Figure 18:
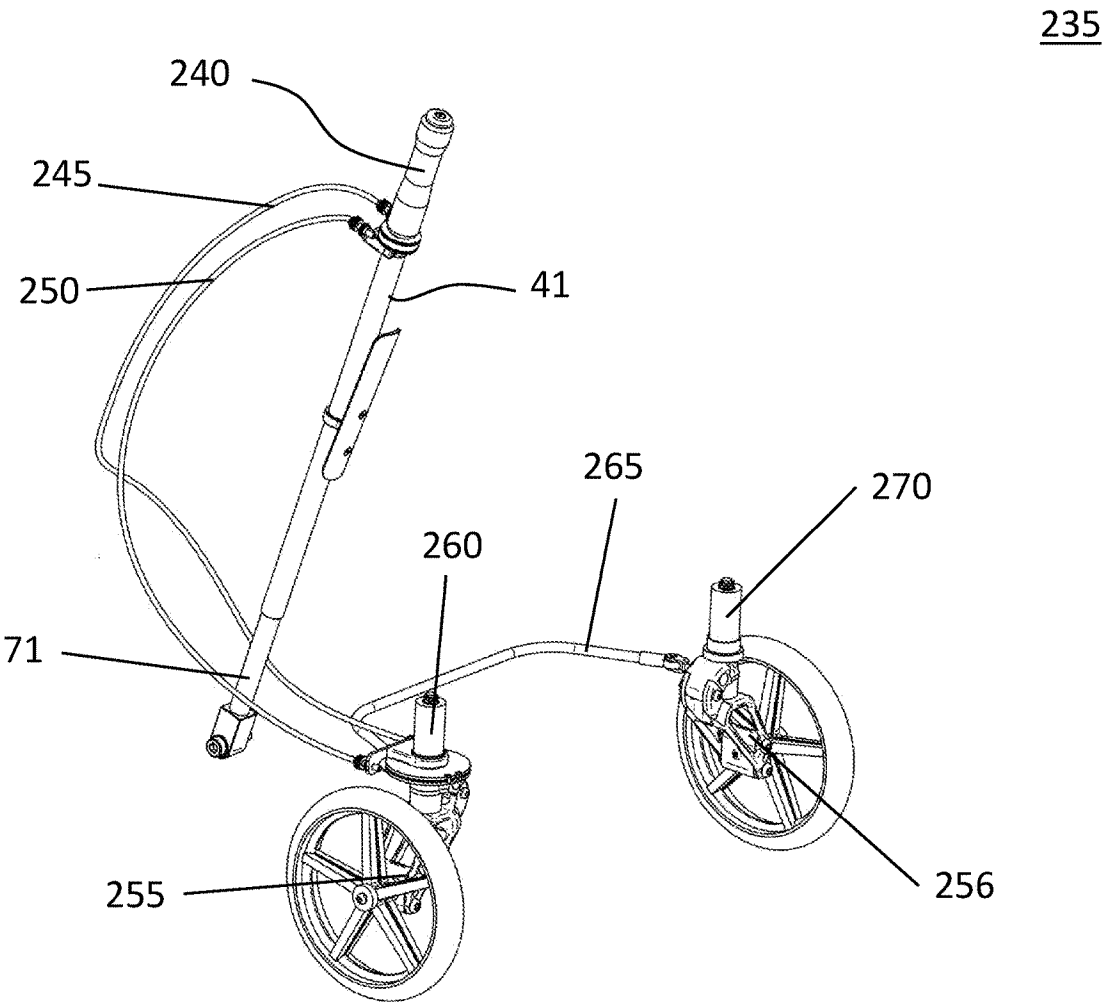
FIG. 18 is a perspective view of the cable driven steering mechanism, according to one embodiment of the present invention.
Figure 19B:
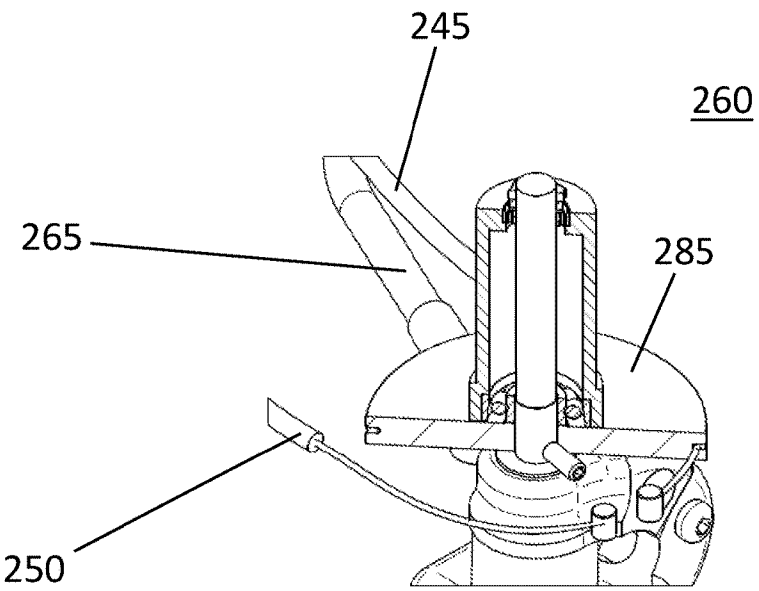
FIG. 19*b* is a cross sectional view of the cable controlled steering column, according to one embodiment of the present invention.
Figure 19A:
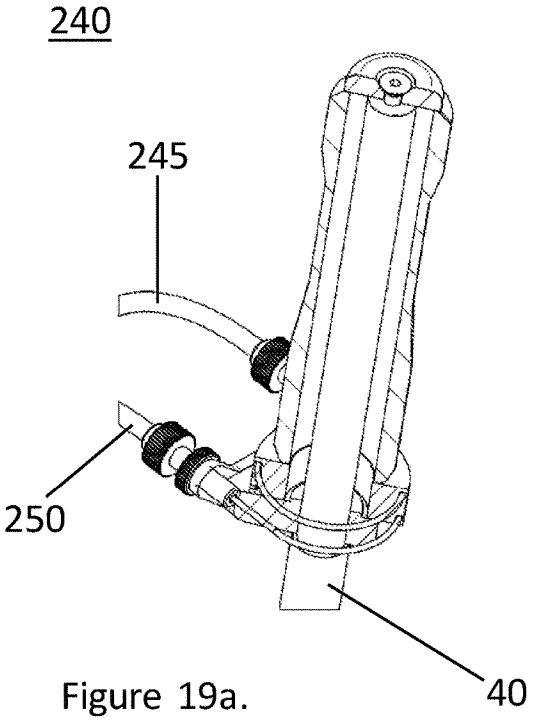
FIG. 19*a* is a cross sectional view of the cable driven steering controller, according to one embodiment of the present invention.

With reference to FIGS. 18, 19, and 20, and according to one embodiment of the present invention, a steering mechanism 235 is described in greater detail. The steering mechanism 235 is incorporated into the right drive lever assembly 41. The operator can control the hand propelled wheeled vehicle's direction of travel by operating the steering controller 240 located on the handle of the right drive lever assembly 41. The right and left steering assemblies, 255 and 256, respectively, are comprised of right and left suspension forks, 261 and 271 respectively, and right and left steering tires, 24 and 25 respectively. Through the rotation of the controller 240 the operator can efficiently control the direction in which the hand propelled wheel vehicle is travelling. Rotation of the controller 240 rotates the right steering column 260, causing the right steering assembly 255 to rotate and to move the tie rod 265. The movement of the tie rod 265 causes the left steering assembly 256 to rotate in correspondence with the right steering assembly 255. The controller 240 and the right steering column 260 are mated through the left and right steering cables, 275 and 280, respectively. With specific reference to FIG. 19*a*, controller 240 is shown in greater detail. To further illustrate the mechanism, a cross-sectional view of the controller 240 is shown. The controller 240 rotates around the lever assembly 40. The rotation of the controller 240, pushes and pulls the left and right steering cables, 275 and 280, respectively, which are fixed at the base of the controller 240. The pushing and pulling of the left and right steering cables, 275 and 280, respectively, affects the apparent length of the resultant wire at the opposite end of the respective steering cables, which are attached to the steering drive disc (not shown). With specific reference to FIG. 19*b*, the right steering column 260 is shown in greater detail. To further illustrate the mechanism, a cross-sectional view of the right steering column 260 is shown. The left and right steering cables, 275 and 280, are fixed to the steering drive disc 285. The change in apparent length of the left and right steering cables, 275 and 280, respectively, rotates the steering drive disc 285 and subsequently the right steering column 260. Rotation of the right steering column 260, turns the right steering assembly (not shown), which is directly connected to the right steering column 260, and pulls or pushes the steering tie rod 265. The pushing and pulling of the tie rod 265 rotates the left steering assembly (not shown) about the left steering column (not shown).

Figure 20C:
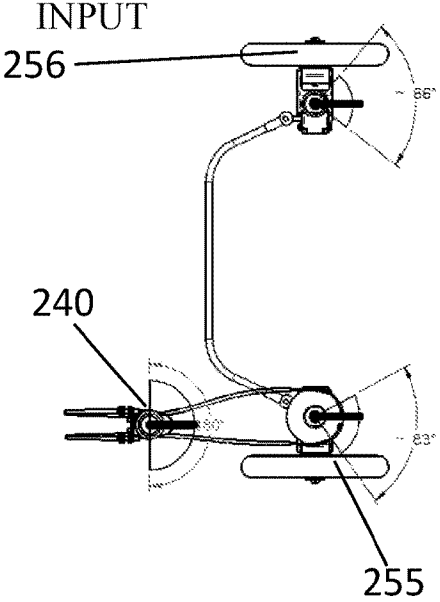
FIG. 20*c* is a top view schematic of the steering mechanism at straight forward input, according to one embodiment of the present invention; and, FIG. 21 is the brake mechanism, according to one embodiment of the present invention.
Figure 20B:
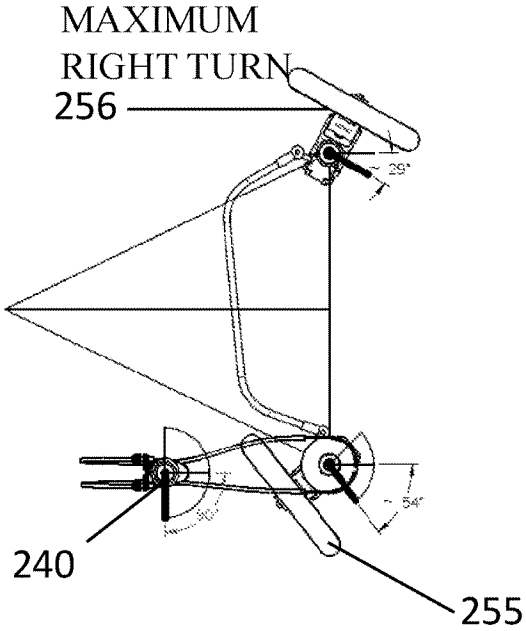
FIG. 20*b* is a top view schematic of the steering mechanism at maximum right turn input, according to one embodiment of the present invention.
Figure 20A:
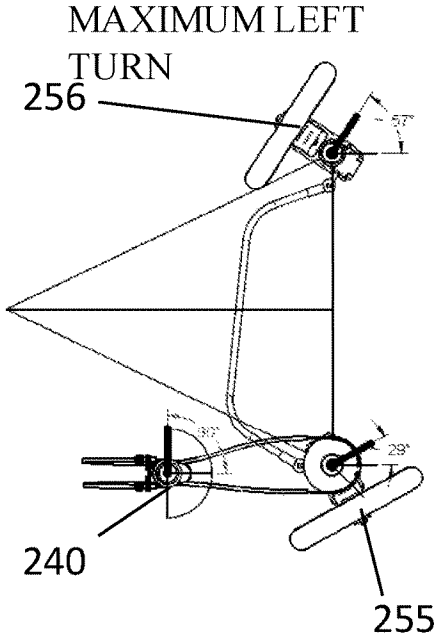
FIG. 20*a* is a top view schematic of the steering mechanism at maximum left turn input, according to one embodiment of the present invention.

With reference to FIG. 20, the turning mechanism 235 is shown in greater detail. To ensure a smooth turn in the left and right direction, the inside steering assembly for a given turn has a higher turn radius than the outside steering assembly. With specific reference to FIG. 20*a*, the turning mechanism 235 is shown in a maximum left turn configuration. The inner steering assembly, in this case the left steering assembly 256, has a higher turning radius than the outer, or right steering assembly 255, when the controller 240 is rotated left 90 degrees. Similarly, and with specific reference to FIG. 20*b*, the turning mechanism 235 is shown in a maximum right turn. The inner steering assembly, in this case the right steering assembly 255, has a higher turning radius than the outer or left steering assembly 256 when the controller 240 is turned right 90 degrees. The configurations shown in FIGS. 20*a* and 20*b* demonstrate that a smooth turning arc is achieved, as the steering geometry allows for the inner wheel to move slower than the outer wheel in a turning scenario. With specific reference to FIG. 20*c*, the turning mechanism 235 is shown with a straight forward input, when the hand propelled wheel vehicle (not shown) is moving in a straight path. When the controller is unturned, the right and left steering assemblies, 255 and 256, respectively, are parallel and tracking forward.

Figure 21:
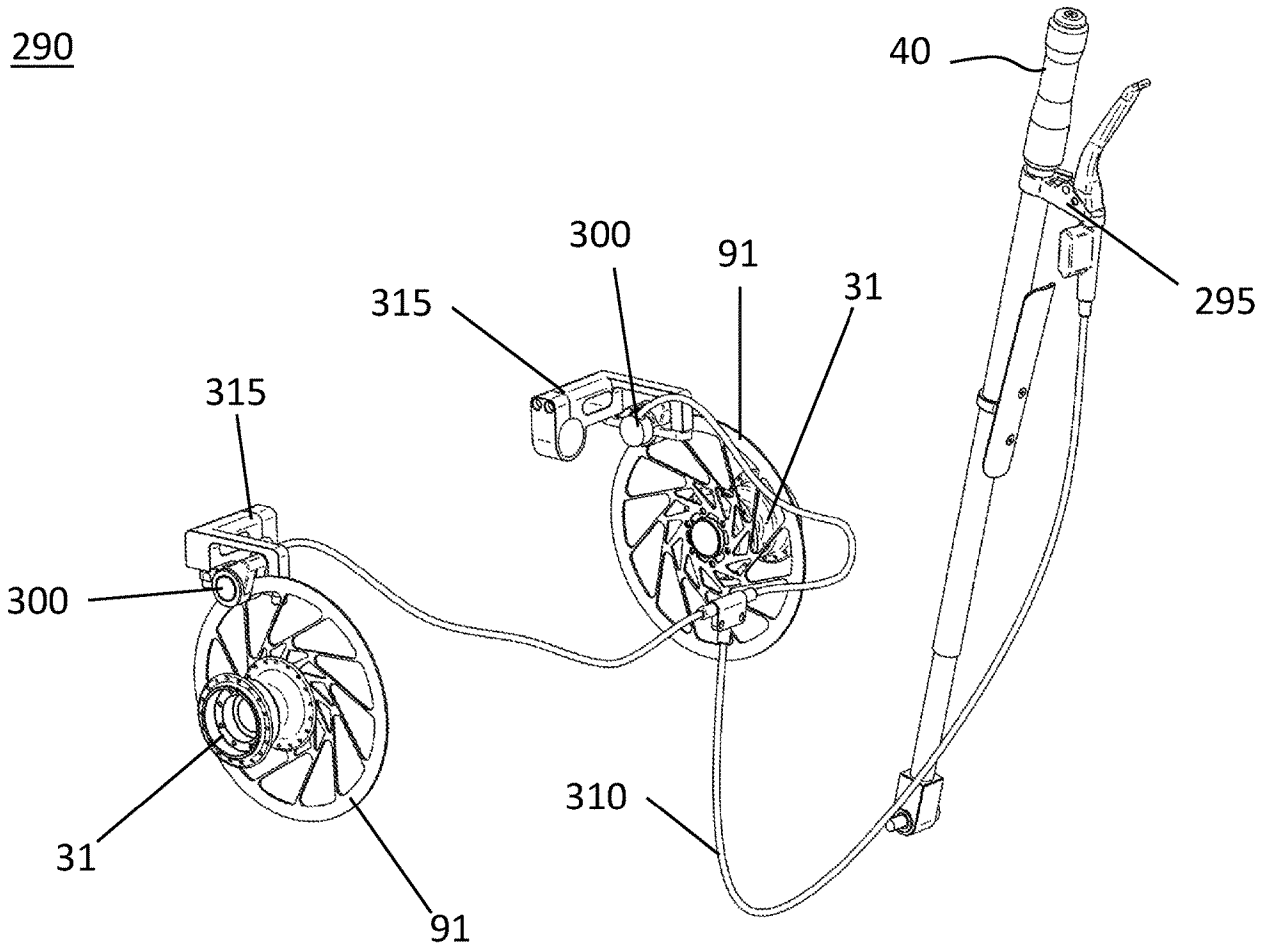

With reference to FIG. 21, and according to one embodiment of the present invention, a braking mechanism 290 is described in greater detail. The braking mechanism 290 is primarily comprised of: a brake lever 295; bake discs 91; brake calipers 300; and, a brake line 310. The braking mechanism 290 is incorporated into the left drive lever assembly 40. As such, the operator can operate the hand propelled wheeled vehicle through manipulation of the left drive lever assembly 40. The operator can brake by applying pressure on the brake lever 295. When applying pressure to the brake lever, the brake calipers 300 on the left and right sides of the chair engage with the brake disc 91 thereby slowing down the disc's rotation, in turn slowing the rotation of the wheel hub 31. The brake system can be actuated hydraulically, or via a cable system. A worker skilled in the relevant art would appreciate the various means that can be used to slow down a wheeled vehicle and the placement/composition of a braking mechanism. Additionally, the braking lever 295 has the ability to lock when activated, acting as a parking brake to keep the hand propelled wheeled vehicle stationary when the operator is entering or egressing the hand propelled wheeled vehicle, and when parked.

The term means of connecting the propulsion mechanism to the drive wheel includes, but is not limited to, the drive shaft assembly or any other means of connecting described in the figures.

The term efficient means of providing directional control includes, but is not limited to, a steering system, steering controller, right steering assembly, left steering assembly, right steering column, right suspension fork, steering tie rod, left steering column, left suspension fork and steering drive disc or any other means of providing directional control described in the figures.

The term efficient means of providing braking capabilities includes, but is not limited to, a braking mechanism, brake lever, brake caliper, brake line and brake caliper mount or any other braking capabilities described in the figures.

The invention claimed is:

1. A hand propelled wheeled device for a rider comprising:
- a frame to support the rider;
- at least two wheels mounted to the frame for displacement of the rider;
- a propulsion mechanism that converts an applied linear force into rotational force for rotating a drive wheel and propelling the wheeled device, the propulsion mechanism further comprising:
  - a drive frame;
  - at least two clutch drivers operatively connected to the drive frame and secured to at least two clutches, the at least two clutch drivers and the at least two clutches converting a linear motion of the drive frame into rotational motion; and,
  - a drive shaft coupled to the at least two clutches and connected to the drive wheel for displacing the wheeled device;
- wherein the rider moves the drive frame linearly across the at least two clutch drivers causing the at least two clutch drivers to contra-rotate;
- a means of connecting the propulsion mechanism to the drive wheel; and
- a drive lever assembly for providing directional control and braking capabilities of the wheeled device.

2. The drive lever assembly of claim 1 further comprising:
- lever shaft attached to both the drive frame through a knuckle and to the frame through a pivot block;
- a brake lever connected to a brake disc and a caliper through a brake line to control braking of the wheeled device;
- a steering controller to control the direction of the wheeled device; and
- wherein a drive frame connection point positioned at the knuckle is adjustable along the lever shaft relative to the pivot block, providing an adjustable range of travel of the drive frame, to enable a variable selection of torque and displacement applied to driving wheels of the wheeled device.

3. The propulsion mechanism of claim 1 wherein the at least two clutch drivers are pulleys and the linear motion of the drive frame is converted to contra-rotating motion of the at least two clutch drivers through a fixed cable pulley mechanism.

4. The propulsion mechanism of claim 1 wherein the at least two clutch drivers are pulleys and the linear motion of the drive frame is converted to contra-action of the at least two clutch drivers through a wraparound tensioned cable mechanism.

5. The propulsion mechanism of claim 1 wherein the at least two clutch drivers are pinion gears and the linear motion of the drive frame is converted to contra-rotating motion of the at least two clutch drivers through a rack and pinion mechanism.

6. The propulsion mechanism of claim 1 wherein the at least two clutch drivers are sprockets and the linear motion of the drive frame is converted to contra-rotating motion of the at least two clutch drivers through a sprocket and pin rack mechanism.

7. The propulsion mechanism of claim 1 wherein the at least two clutch drivers are sprockets and the linear motion is converted to contra-rotating motion of the at least two clutch drivers through a floating rail sprocket and chain mechanism.

8. The propulsion mechanism of claim 1 wherein the at least two clutch drivers are sprockets and the linear motion is converted to contra-rotating motion of two clutch drivers through a fixed rail sprocket and chain mechanism.

9. The propulsion mechanism of claim 1 wherein the at least two clutch drivers are differential gears and a ballscrew backdriving is converted to contra-rotating motion of the at least two clutch drivers through a ballscrew/differential gear mechanism.

10. The hand propelled wheeled device of claim 1 wherein the hand propelled wheeled device is a wheelchair.

11. The hand propelled wheeled device of claim 1 wherein the hand propelled wheeled device is a vehicle such as a go cart, bicycle, tricycle or any land vehicle having at least one driving wheel.

12. A propulsion mechanism comprising:

a drive frame;

at least two clutch drivers operatively connected to the drive frame and secured to at least two clutches, the at least two clutch drivers and the at least two clutches converting a linear motion into a rotational motion; and a drive shaft coupled to the at least two clutches and connected to a drive wheel for displacing a device;

wherein the drive frame is moved linearly across the at least two clutch drivers causing the at least two clutch drivers to contra-rotate; and wherein the propulsion mechanism is configured to convert a linear force into a rotational force for rotating the drive wheel and propelling the device.

* * * * *